US010400568B2

(12) United States Patent
Kasevich et al.

(10) Patent No.: US 10,400,568 B2
(45) Date of Patent: Sep. 3, 2019

(54) SYSTEM AND METHODS FOR CONTROLLED FRACTURING IN FORMATIONS

(71) Applicant: Chevron U.S.A. Inc., San Ramon, CA (US)

(72) Inventors: Raymond Stanley Kasevich, Great Barrington, MA (US); Jeb Xiaobing Rong, Mount Washington, MA (US); James Preston Koffer, Delta, CO (US); Mark Dean Looney, Conroe, TX (US); Margaretha Catharina Maria Rijken, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 15/861,909

(22) Filed: Jan. 4, 2018

(65) Prior Publication Data

US 2018/0202273 A1 Jul. 19, 2018

Related U.S. Application Data

(63) Continuation-in-part of application No. 14/568,760, filed on Dec. 12, 2014, now Pat. No. 9,890,627.
(Continued)

(51) Int. Cl.
*E21B 43/26* (2006.01)
*E21B 43/16* (2006.01)
(Continued)

(52) U.S. Cl.
CPC ..... *E21B 43/26* (2013.01); *E21B 7/15* (2013.01); *E21B 33/124* (2013.01);
(Continued)

(58) Field of Classification Search
None
See application file for complete search history.

(56) References Cited

U.S. PATENT DOCUMENTS 3,169,577 A 2/1965 Sarapuu
3,279,540 A 10/1966 Lange et al.
(Continued)

FOREIGN PATENT DOCUMENTS

WO 2013/149308 A1 10/2013
WO 2015/089405 A1 6/2015

OTHER PUBLICATIONS

"Electrical Impedence"; Encyclopaedia Britannica, downloaded on Jan. 29, 2018, https://www.britannica.com/science/electrical-impedence, 2 pages.
(Continued)

*Primary Examiner* — Andrew Sue-Ako

(57) ABSTRACT

Embodiments of generating controlled fractures in geologic formation are provided herein. In one embodiment, a method comprises preconditioning by applying a sufficient amount of energy comprising AC power to the electrodes to induce an electrical field between opposite electrode contact points to generate a least one conductive channel between a pair of electrodes. The generation of the conductive channel is complete when current flow measured by a network analyzer exhibits a measured reduction of channel resistance of 90% ohms or more in 6 hours or less from when preconditioning first began. The method further comprises, subsequent to generating the conductive channel, fracturing by applying electrical impulses to the electrodes. The application of the electrical pulses generates multiple controlled fractures within and about the conductive channel. The energy is applied using a single phase configuration, a multiphase configuration, or any combination thereof.

45 Claims, 7 Drawing Sheets

Related U.S. Application Data

(60) Provisional application No. 61/915,785, filed on Dec. 13, 2013.

(51) Int. Cl.

| | |
|---|---|
| ***E21B 43/24*** | (2006.01) |
| ***E21B 43/00*** | (2006.01) |
| ***E21B 33/124*** | (2006.01) |
| ***E21B 7/15*** | (2006.01) |

(52) U.S. Cl.

CPC ..... *E21B 43/006* (2013.01); *E21B 43/168* (2013.01); *E21B 43/24* (2013.01)

(56) References Cited

U.S. PATENT DOCUMENTS

| | | | | |
|---|---|---|---|---|
| 3,292,701 | A | 12/1966 | Goodwin et al. | |
| 3,460,766 | A | 8/1969 | Sarapuu | |
| 3,474,878 | A | 10/1969 | Loren | |
| 3,695,715 | A | 10/1972 | Godfrey | |
| 3,794,976 | A | 2/1974 | Mickler | |
| 4,046,194 | A | 9/1977 | Cloud | |
| 4,084,638 | A | 4/1978 | Whiting | |
| 4,135,579 | A | 1/1979 | Rowland et al. | |
| 4,140,179 | A | 2/1979 | Kasevich et al. | |
| 4,196,329 | A | 4/1980 | Rowland et al. | |
| 4,199,025 | A | 4/1980 | Carpenter | |
| 4,282,587 | A | 8/1981 | Silverman | |
| 4,320,801 | A | 3/1982 | Rowland et al. | |
| 4,348,635 | A | 9/1982 | Wright et al. | |
| 4,468,623 | A | 8/1984 | Gianzero et al. | |
| 4,479,680 | A | 10/1984 | Wesley et al. | |
| 4,557,325 | A | 12/1985 | Gall | |
| 4,567,945 | A | 2/1986 | Segalman | |
| 4,653,697 | A | 3/1987 | Codina | |
| 4,667,738 | A | 5/1987 | Codina | |
| 4,741,405 | A | 5/1988 | Moeny et al. | |
| 5,243,521 | A | 9/1993 | Luthi | |
| 5,355,802 | A | 10/1994 | Petitjean | |
| 5,573,307 | A | 11/1996 | Wilkinson et al. | |
| 5,620,049 | A | 4/1997 | Gipson et al. | |
| 6,023,168 | A | 2/2000 | Minerbo | |
| 6,148,911 | A | 11/2000 | Gipson et al. | |
| 7,270,195 | B2 | 9/2007 | MacGregor et al. | |
| 7,520,324 | B2 | 4/2009 | Chen et al. | |
| 7,631,691 | B2 | 12/2009 | Symington et al. | |
| 7,819,181 | B2 | 10/2010 | Entov et al. | |
| 8,220,537 | B2 | 7/2012 | Leon et al. | |
| 8,869,888 | B2 | 10/2014 | Cramer et al. | |
| 9,243,487 | B2 | 1/2016 | Geilikman et al. | |
| 9,328,594 | B2 | 5/2016 | Linetskiy | |
| 9,394,775 | B2 | 7/2016 | Rey-Bethbeder et al. | |
| 9,840,898 | B2 * | 12/2017 | Kasevich | E21B 33/124 |
| 9,890,627 | B2 * | 2/2018 | Kasevich | E21B 33/124 |
| 2003/0137182 | A1 | 7/2003 | Moeny | |
| 2003/0173082 | A1 | 9/2003 | Vinegar et al. | |
| 2005/0150688 | A1 | 7/2005 | MacGregor et al. | |
| 2007/0107901 | A1 | 5/2007 | Maguire | |
| 2007/0152494 | A1 | 7/2007 | Moeny | |
| 2007/0256830 | A1 | 11/2007 | Entov et al. | |
| 2008/0230219 | A1 | 9/2008 | Kaminsky | |
| 2009/0166024 | A1 | 7/2009 | Chen et al. | |
| 2010/0101793 | A1 | 4/2010 | Symington et al. | |
| 2010/0229749 | A1 | 9/2010 | Veneruso | |
| 2011/0060572 | A1 | 3/2011 | Brown et al. | |
| 2011/0065161 | A1 | 3/2011 | Kwasinski et al. | |
| 2012/0325458 | A1 | 12/2012 | El-Rabaa et al. | |
| 2013/0112403 | A1 | 5/2013 | Meurer et al. | |
| 2013/0255936 | A1 | 10/2013 | Geilikman et al. | |
| 2014/0008072 | A1 | 1/2014 | Rey-Bethbeder et al. | |
| 2014/0008073 | A1 | 1/2014 | Rey-Bethbeder et al. | |
| 2014/0032116 | A1 | 1/2014 | Guner et al. | |
| 2014/0239956 | A1 | 8/2014 | Hoversten et al. | |
| 2014/0251623 | A1 * | 9/2014 | Lestz | E21B 43/26 166/308.2 |
| 2014/0374084 | A1 | 12/2014 | Mace et al. | |
| 2014/0374091 | A1 | 12/2014 | Wilt et al. | |
| 2015/0040788 | A1 | 2/2015 | Albakri et al. | |
| 2015/0167439 | A1 | 6/2015 | Kasevich et al. | |
| 2015/0167440 | A1 | 6/2015 | Kasevich et al. | |
| 2016/0024901 | A1 | 1/2016 | Youhong et al. | |
| 2016/0145987 | A1 * | 5/2016 | Symington | E21B 36/04 166/248 |
| 2016/0348479 | A1 * | 12/2016 | Oehring | F01D 15/08 |

OTHER PUBLICATIONS

Cho, S.H., et al.; "Dynamic Fragmentation of Rock by High-Voltage Pulses"; ARMA/USRMS 06-1118, American Rock Mechanics Association, (Jun. 2006), 9 pages.

Harak, Arnold E., et al.; "An Overview of In Situ Recovery Research at the Laramie Energy Technology Center"; Energy Technology Conference and Exhibition, Houston, TX, (Nov. 1978), Title page, and pp. 1-27.

Liu, Lanbo; "Fracture Characterization Using Borehole Radar: Numerical Modeling"; Water, Air, and Soil Pollution: Focus, (2006), vol. 6, pp. 17-34.

MacDonald, J. Ross; "Impedance Spectroscopy"; Annals of Biomedical Engineering, (1992), vol. 20, pp. 289-305.

Mathews, Jonathan P., "Enhancing Appalachian Coalbed Methane Extraction by Microwave-Induced Fractures"; RPSEA Final Report, 07122-27-Final, (Aug. 5, 2010), Part 1.

Mathews, Jonathan P., "Enhancing Appalachian Coalbed Methane Extraction by Microwave-Induced Fractures"; RPSEA Final Report, 07122-27-Final, (Aug. 5, 2010), Part 2.

Mathews, Jonathan P., "Enhancing Appalachian Coalbed Methane Extraction by Microwave-Induced Fractures"; Thesis, RPSEA Final Report, 07122-27-Final, (Aug. 5, 2010), Part 3.

Mathews, Jonathan P., "Enhancing Appalachian Coalbed Methane Extraction by Microwave-Induced Fractures"; Thesis, RPSEA Final Report, 07122-27-Final, (Aug. 5, 2010), Part 4.

Melton, Noel M., et al.; "Fracturing Oil Shale with Electricity"; Laramie Petroleum Research Center, Bureau of Mines, Quarterly of the Colorado School of Mines, (1963), vol. 63, No. 3, pp. 611-627.

Monchusi, B.; "Microwave-Assisted Rock Breaking Modelling and Application"; CSIR Centre for Mining Innovation, South Africa, Oct. 2012, 1 page.

Sarapuu, Erich; "Electrofrac Heatflood is a Cyclic, Electrically Augmented In Situ Combustion Process for Oil Well Stimulation and Enhanced Oil Recovery"; Thesis, (2005), 61 pages.

International Search Report, dated Mar. 31, 2015, during the prosecution of International Application No. PCT/US2014/070037.

Written Opinion of the International Searching Authority, dated Mar. 31, 2015, during the prosecution of International Application No. PCT/US2014/070037.

* cited by examiner

SYSTEM AND METHODS FOR CONTROLLED FRACTURING IN FORMATIONS

CROSS-REFERENCE TO RELATED APPLICATIONS

The present application claims priority as a continuation-in-part application from U.S. application Ser. No. 14/568,760, filed on Dec. 12, 2014, as well as U.S. Provisional Patent Application No. 61/915,785, filed on Dec. 13, 2013, both of which are also hereby incorporated by reference in their entireties.

TECHNICAL FIELD

The invention relates generally relate to methods for controlled fracturing in formations to improve permeability.

BACKGROUND

It is known in the art to fracture rocks by passing pulses of current between electrodes within a formation. Melton and Cross in Quarterly, Colorado School of Mine, July 1967, Vol. 62, No. 3, pp. 25-60, disclosed field tests in which alternating current electricity was passed through oil shale to create horizontal permeable paths for subsequent fire flooding to heat the oil shale and produce hydrocarbons by thermal cracking of kerogen.

In U.S. Pat. No. 7,631,691, methods are disclosed to fracture a formation by first providing wells in a formation, and then one or more fractures are established in the formation such that each fracture intersects at least one of the wells. Electrically conductive material is subsequently placed in the fracture, and an electric voltage is applied across the fracture and through the material to generate heat to pyrolyze organic matter in the formation to form producible hydrocarbons.

U.S. Pat. No. 7,270,195 discloses methods and apparatuses to form a bore during drilling operations by plasma channel drilling using high voltage, high energy, and rapid rise time electric pulses. US Patent Publication No. 2013/0255936 discloses a method to produce hydrocarbons from a formation by applying differential voltage between a pair of electrodes placed within a formation to remove a fraction between $10^{-6}$ and $10^{-4}$ of the mineral mass in the formation between the electrodes, followed by the production of hydrocarbons, e.g., natural gas, from the formation.

There is still a need for improved systems and methods for fracturing of formations, particularly controlled fracturing in large volumes of tight geologic formations to create multi-dimensional patterns of fracture within, for the economic recovery of any of solids, liquids and gases.

SUMMARY

In one embodiment, a method of generating controlled fractures in geologic formation comprises providing a plurality of boreholes in the formation and placing a plurality of electrodes in the boreholes with at least one electrode per borehole, with the plurality of electrodes defining a fracture pattern for the geologic formation. The method further comprises preconditioning by applying a sufficient amount of energy comprising AC power to the electrodes to induce an electrical field between opposite electrode contact points to generate a least one conductive channel between a pair of electrodes. The conductivity in the channel between the pair of electrodes is defined as a ratio of final to initial channel conductivity of 10:1 to 50,000:1. Generation of the conductive channel is complete when current flow measured by a network analyzer exhibits a measured reduction of channel resistance of 90% ohms or more in 6 hours or less from when preconditioning first began. The method further comprises, subsequent to generating the conductive channel, fracturing by applying electrical impulses to the electrodes, the electrical impulses having a voltage output ranging from 100-2000 kV, and an energy output of 10-1000 kJ. The pulses have a rise time ranging from 0.05-500 microseconds and a half-value time of 50-5000 microseconds. The application of the electrical pulses generates multiple controlled fractures within and about the conductive channel by disintegration of minerals and pyrolysis of organic materials in the formation. The energy is applied using a single phase configuration, a multiphase configuration, or any combination thereof.

In one embodiment, a method of generating controlled fractures in a formation containing connate water comprises applying a sufficient amount of energy comprising AC power to a plurality of electrodes placed in a plurality of boreholes in the formation, with at least one electrode per borehole, to induce an electrical field between opposite electrode contact points to generate at least one conductive channel between a pair of electrodes and to heat the connate water in the formation to either a subcritical condition or supercritical condition. Generation of the conductive channel is complete when current flow measured by a network analyzer exhibits a measured reduction of channel resistance of 90% ohms or more in 6 hours or less from when first applying the sufficient amount of energy comprising AC power to the electrodes. The method further comprises, after generating the conductive channel, fracturing the formation by applying electrical impulses having a voltage output ranging from 100-2000 kV, and an energy output of 10-1000 kJ. The pulses have a rise time ranging from 0.05-500 microseconds and a half-value time of 50-5000 microseconds. The application of the electrical pulses generates plasma shock waves in the water thereby creating multiple controlled fractures within and about the conductive channel in the formation. The energy is applied using a single phase configuration, a multiphase configuration, or any combination thereof.

In one embodiment, a system for generating controlled fractures in geologic formation comprises a plurality of electrodes placed in a formation in a plurality of boreholes. The plurality of electrodes define a fracture pattern for the geologic formation. The system further comprises a preconditioning generator for delivering energy comprising AC power to the electrodes to generate at least one conductive channel between a pair of electrodes with the conductivity in the channel having a ratio of final to initial channel conductivity of 10:1 to 50,000:1, the energy applied to the electrodes to generate the conductive channel is selected from electromagnetic conduction, radiant energy and combinations thereof. The system further comprises an impulse generator for generating electrical impulses with a voltage output ranging from 100-2000 kV, with the pulses having a rise time ranging from 0.05-500 microseconds and a half-value time of 50-5000 microseconds. The application of the electrical pulses generate multiple fractures surrounding and within the conductive channel by disintegration of minerals and inorganic materials and pyrolysis of organic materials in the formation. The energy is applied using a single phase configuration, a multiphase configuration, or any combination thereof.

DETAILED DESCRIPTION

Figure 1:
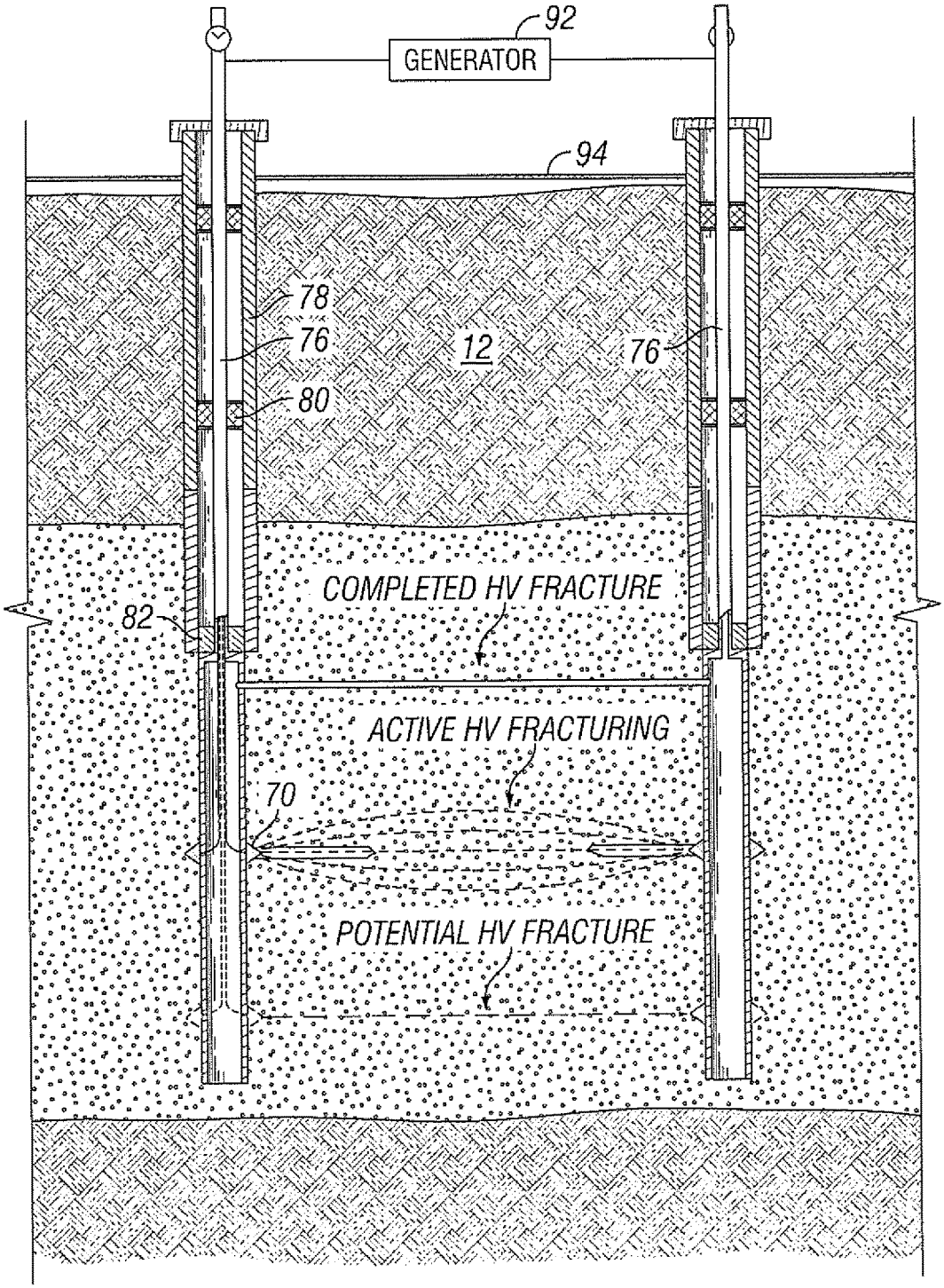
FIG. 1 illustrates an embodiment of a system of the invention using a single phase configuration.

The invention relates to a system and a method employing a combination of alternating and impulse current waveforms applied in succession to achieve extensive fracturing and disintegration of rock materials, generating three dimensional fracture patterns. In a pre-conditioning step, alternating current (e.g., AC or half-wave AC) electric field is applied to electrodes in the formation. The electrical discharge reduces the formation resistivity by dielectric heating and ionization, causing the rock to fracture with disintegration in multiple directions (micro-fracturing), but confined between the locations of electrode pairs of opposite polarity, effecting carbon production to establish conductive channels in the formation.

As used herein, "channel" refers to a direct path in the formation in between two electrodes, following the established electric field pattern after the application of high voltage to the electrodes. The channel is characterized as having different physical and chemical characteristics from the surrounding rock formation, e.g., having increased content of iron oxides, various ions, carbon, and higher electrical conductivity compared to original properties. The channel may or not be continuous, e.g., with some variations in properties along the length. The size of the channel (e.g., width, diameter, etc.) varies depending on the formation characteristics, electrode spacings, and the applied voltage, current flow and frequency.

After pre-conditioning and once low resistivity condition is achieved, impulse current waveforms are applied to the established channels to create ionization leading to intense plasma discharge along the created conductive path, resulting in rapid heating and pressurization of the surrounding rock, connate water, and any contained energy along the conductive path, resulting in rock disintegration with attendant large scale multiple fracturing.

A system of plurality of borehole electrodes can be employed in this method, for any of enhanced hydrocarbon recovery, mineral recovery, environmental remediation applications, and remediating formation damages. "Formation damage" and its related terms (e.g., damaged formation) generally refer to a reduction in the capability of a reservoir to produce minerals, fluids (e.g., oil and gas), such as a decrease in porosity or permeability or both. Formation damages can be caused by physical plugging of pores, alteration of reservoir rock wettability, precipitation of insoluble materials in pore spaces, clay swelling, and blocking by water (i.e., water blocks).

The method does not require additional water to generate fractures. Therefore, it alleviates the need associated with hydraulic fracturing for sourcing water in arid regions, water disposal, and changes to the formation caused by penetration of fluids into the reservoir. In addition, hydraulic fracture direction is dependent on stress direction in the reservoir. Since the method generates fractures between two points regardless of stress direction, unwanted growth of fractures out of zone is mitigated, avoiding potential loss of production to thief zones and affecting the groundwater. By controlling the direction of fracture growth, optimum production patterns, both vertically and horizontally, can be generated to more efficiently drain reservoirs, increasing both rate and ultimate production totals.

The increase in permeability of the subterranean formation correlates to a gain (or increase) in permeability of at least 50% in one embodiment; at least 80% in a second embodiment. Rock permeability is greatly enhanced after fracturing by ratios ranging from 2:1 to 1000:1 in one embodiment; and from 10:1 to 500:1 in a second embodiment.

High Voltage Pre-conditioning with Alternating Current: In one embodiment, conductive electromagnetic energy over a wide range of frequencies from 50 Hz to 100 MHz is applied by a system of electrodes to precondition a specific volume of the formation by altering its electrical, chemical and physical properties. The frequencies range from 100 Hz to 50 MHz in a second embodiment; and from 500 to 10 MHz in a third embodiment. The applied voltage, current flow and frequency can be adjusted in accordance with the measured resistance between the electrodes, which ranges between 10 to 1,000,000 ohms in one embodiment; from 1000 to 500,000 ohms in a second embodiment, depending on variables including but not limited to the physical and chemical parameters of the formation and the distance between the electrodes.

High Current Fracturing: After the pre-conditioning step, a current impulse generator replaces the AC power source to apply high voltage and high current pulse waveforms that are site-specific to the channels created in the pre-conditioning step. In one embodiment, two separate generators are employed. The first generator is for preconditioning, and the second generator is for extensive fracturing of the formation by pulsation of intense current waveforms. In another embodiment, a single generator may be used as both a preconditioning source and impulse voltage source, since the impulse voltage generator contains an AC transformer to deliver electrical charge to the capacitor bank.

The actual current and voltage waveform selected for the fracturing process may vary with the type of rock crystalline structure, organic content and its frequency sensitive impedance characteristics. The application of the voltage waveform produces an intense channel current waveform because of the "short-circuit condition" established during pre-conditioning. In one embodiment, the rise time is at a level of microseconds or less, e.g., in a range of 1-50 μs. In another embodiment, the rise time is in a range of 50-500 μs.

With the application of high voltage bursts of energy, e.g., high voltage, high current e.g., in a range of 10-10,000 kJ (kilo-joule) in one embodiment, from 50-1000 kJ in a second embodiment, an electrical plasma arc burst along the highly conductive path is instantly created. The plasma arc burst raises temperature and the pressure to extreme ranges, e.g., tens of thousands of degrees Fahrenheit and thousands of pounds per square inch. This rapid increase of temperature and pressure exceeds the strengths of the rock, and causes physical changes and damage in the rock formation along and about or surrounding the highly conductive path, which produces fractures that are desirable for well and formation stimulation, e.g., release of hydrocarbons. The step, i.e., application of high voltage pulsed energy, can be repeated to increase the fracturing effect on the rock and further enhance stimulation of extensive but controlled volumetric fracturing. The fractures are within the conductive channel in one embodiment, and in the volume area surrounding the conductive path from a few inches to 5 feet away in a second embodiment; up to 20 feet away from the conductive path in a third embodiment; up to 50 ft. away in a fourth embodiment.

Electrode System: In one embodiment, a plurality of insulated positive and negative electrodes are placed into wellbores in the formation at either end of desired path(s) via wells, holes, or natural openings, with the electrodes contacting the earth at desired points where permeable path(s) or channels are to be developed between pairs of positive and negative electrodes. Each electrode is electrically connected to a high voltage cable or cylinder located within the borehole. Distance between each pair of electrodes ranges between 5-2500 ft. in one embodiment, from 10-1000 ft. in a second embodiment; from 25-500 in a third embodiment. Various electric field patterns can be created by multiples of electrode configurations, with the distance between the electrodes, size, frequency, and polarity varying to create the desired pattern, e.g., arrays of electrodes for overlapping and crisscrossing patterns. Examples of electrode configurations include but not limited to two-wire transmission line, four-wire transmission line, cage-like transmission line structure, antennas, etc., and combinations thereof. The voltage polarities of each electrode are also selected to give the highest number of possible channels within a given volume of the formation. The voltages applied can be time-phased to specific electrode spacings and depths.

In one embodiment, energy may be applied using a single phase configuration, a multiphase configuration, or any combination thereof. For example, the multiphase configuration may comprise three phases, six phases, nine phases, or twelve phases. For example, the multiphase configuration may comprise a plurality of three phases. For example, the multiphase configuration may comprise three phase Delta, three phase Wye, or any combination thereof. In one embodiment, energy may be applied using three phase Delta, three phase Wye, or any combination thereof, such as to allow stimulation of multiple wells at a substantially same time to generate multiple controlled fractures at a substantially same time. However, it may be advantageous to power off certain phases during the multiphase application period to create a more desirable set of fractures based on impedance measurements. Thus, the multiphase configuration may be used for generating the multiple controlled fractures in a time sequence other than a substantially same time.

In one embodiment, the electrode electric field is radially directed away from its surface and enhanced at specific points along the electrode length corresponding in position to the voltage node positions. The enhancements can be in the form of metal point(s), or secondary electrode(s) extending from pipe electrode into the formation. The secondary electrodes can be a single point structure or a multi-point structure (as shown in FIG. 1). The field enhancements greatly assist in creating localized voltage breakdown at the tip of the secondary electrode, initiating localized micro cracking, gas expansions, mobilization of pore water, heat, and carbon production in the formation near the borehole of high conductivity associated with channeling. The localized voltage breakdown extends toward the opposite electrode at a propagation rate of 0.5-10 m/hr. in one embodiment; at 1-5 m/hr. in a second embodiment; generally following the established electric field pattern of the electrodes.

The secondary electrodes can operate individually or in groups through cable connections inside the electrodes, and connected at the surface to switching power supplies. In one embodiment, the secondary electrodes are hydraulically actuated such that they are not protruding from the electrode surface into the formation unless called upon to do so to establish electrical contact with the formation. With the use of secondary electrodes, the initiation of a channel will occur at the depth of the extended electrodes, with other vertical channels being created in this manner for multiple channels. In one embodiment, the point electrode or secondary electrode employs a spring loaded pin to ensure a pressure contact against the borehole wall, for high voltage discharge into the formation with local electric field enhancement by the pin geometry and shape of the secondary electrode.

The depth of the active electrode may be variable in terms of frequency or wavelength. In one embodiment, the electromagnetic field patterns are created with the use of electrodes in the form of cables or pipes conducting high current are employed, as open-ended parallel wire transmission line having the highest electric field or maxima at the secondary (point) electrodes. The field pattern of a two electrode system is established by the potential difference between electrodes, spacing between electrodes, electrode length of each electrode, the dielectric properties of the formation, and frequency of the AC. Initiation of the electron avalanches in the formation occurs where the secondary point electrodes make physical contact with the formation. In one embodiment with the point electrodes being located in a metal casing, the electrodes cut or burn through the casing by high voltage discharge between the electrode point contact and casing wall, thus enabling contact of the point electrode to the formation. In one embodiment, the electrodes are designed to extend telescopically into the formation to effectively generate electron avalanches to initiate high voltage fracture conditions.

In one embodiment, the electromagnetic field pattern is created with the use of antenna structure, with a mosaic of antennas acting as electrodes. The antenna electrodes can be altered in time phasing of input current or voltage to change the energy distribution between boreholes, thereby achieve more uniform fracturing in the volume intended.

The secondary electrodes provide enhanced electric fields or high voltage gradients at specific points along the surface of the active electrode directed to the opposite electrode, generating radial electric fields. In one embodiment, the radial electric fields generated by the electrodes can be sufficiently enhanced to initiate an electron avalanche condition similar to a Townsend discharge with the injection of an easily ionizable gas (or "EIE"—easily ionizable element) through one or more ports provided in the electrode. Examples of easily ionizable gases include neon, argon, or a Penning mixture (99.5 percent neon and 0.5 percent argon). The gas injection can influence the characteristics of plasma discharge, as well as the current characteristics of the discharge (current intensity), increasing activity by lattice vibrations created by the electric field and temperature effects. The easily ionizable gas can be injected into the formation through separate ports, or through the point electrode ports. The intense fields originate at the electrode surface and terminate at the surface of the opposite electrode in the adjacent borehole. The electron avalanche created in the formation by the intense electric field at the surface of the positive polarity electrode creates a localized ionization effect in the rock, which propagates to the opposite electrode of negative polarity. It should be noted that similar conditions of voltage breakdown are occurring simultaneously at the opposite electrode of negative polarity with attendant propagation of ionization to the electrode of positive polarity.

In one embodiment, the electrode is a high voltage electrode packer (HVEP) system with at least a double packer, allowing extended penetration into the formation for improved fracture efficiency. The system comprises an upper packer and a lower packer and electrodes disposed between the upper and lower packer and defining a spark gap between the pair of electrodes. The high voltage electrodes in the double packer compartment are insulated from upper and lower metal structures outside the inflatable packers by the packer material itself, with the inflatable packers made from non-conductive material, e.g., fiberglass. The packers provide a sealed compartment for the high voltage electrodes, allowing a gas compartment to support lower breakdown voltages. In one embodiment, the HVEP system is provided with a plurality of injection ports, allowing the injection of gas mixtures (e.g., injected air gas into the formation) to measure permeability increase.

Figure 9:
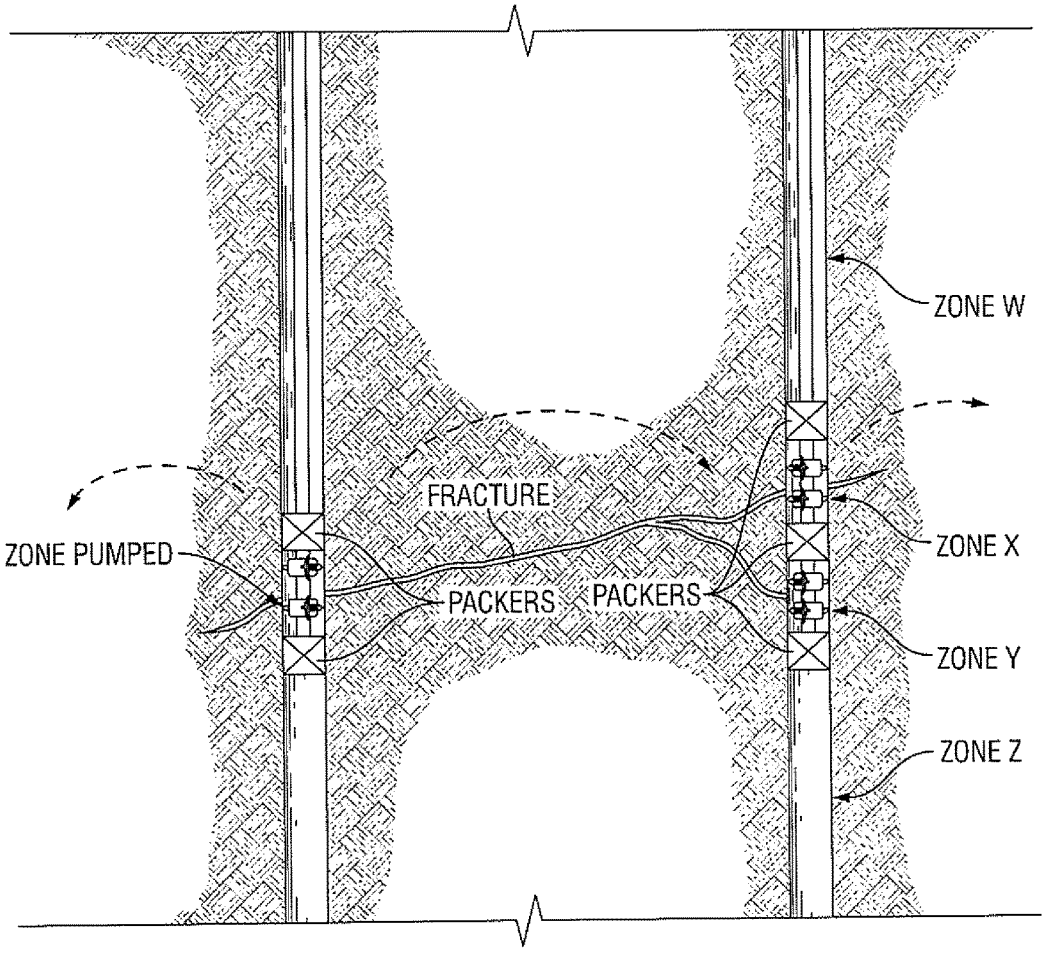
FIG. 9 illustrates an embodiment of a system employing a high voltage electrode packer (HEVP) system

In one embodiment as shown in FIG. 9, a plurality of HVEP's are used with multiple electrodes for extended ground electrode effect. In yet another embodiment, a plurality of electrodes with single point structure are placed between special packers so as to widen the ground return aperture, or the size of effective ground created by the return electrode. With the plurality of electrodes, the grounding electrically dominates over other nearby potential grounding points at various distances from the return electrode borehole. The spreading of contact points ranges from ½ foot to 5-15 feet along the conductor in one embodiment, from 5 to 50 feet in a second embodiment. The positions of the electrodes can be either manually or automatically adjusted during the preconditioning phase. The re-position allows the focus of the electric field between the opposing electrodes (opposite voltage polarity) to be optimized for improving energy fracture efficiency.

In one embodiment, the enhanced electric field around each electrode initially results in dewatering of the material and micro cracking with physical spaces. This further enhances voltage gradient or electric fields around and adjacent to the electrode. The electric field enhancements ionize the material by high voltage breakdown mechanisms, whereby a wave of ionization begins propagation toward the opposite electrode. This enhanced electric field process of producing channels of high electrical conductivity between electrodes by ionization is similar to the stepping process of a lightning discharge, whereby a ionization leader is established that extends the ionization path from cloud to ground, cloud to cloud, or cloud to ionosphere. In the preconditioning step, physical and chemical changes in the rock material channel where ionization occurs may also increase the content of iron oxides, various ions, carbon, all of which enhance electrical conductivity.

The avalanche and resultant ionization directions of propagation will depend on the electrode design and relative locations of electrodes in the formation. In one embodiment, ionization of the formation dielectric creates a high value of electrical conductivity as that of carbon, e.g., a value of 10,000 S/m, allowing for multiple fracturing between electrodes by very high currents in ensuing applications of high voltage waveforms. Channels of intense currents, hundreds to thousands of amperes, develop shock waves in the dielectric material, leading to multiple fracturing with branching of fractures from the main current path directions.

The conductivity volume can be continuously monitored by electrode impedance measurements (e.g., Cole-Cole plots or Smith plots) to insure that the volume to be fractured has sufficiently low resistance or high conductivity in preparation for the application of very intense currents in the high-current fracturing step. The volumetric electrical resistance can be monitored by network analyzer measurements (e.g., Smith charts).

In one embodiment, the high conductivity channel effect gradually reduces the overall resistance between electrodes as measured at the surface by impedance measuring equipment. The ratios of final to initial channel conductivities may range from 10:1 to 50,000:1 in one embodiment, and from 100:1 to 1500:1 in a second embodiment.

In one embodiment of the pre-conditioning step, high voltage electricity, e.g., 1-200 kV is fed to the electrodes from a high voltage AC transformer at the surface. The electrodes can be steel tubing or pipes positioned within or outside a well casing. The electrodes establish controlled electric field patterns between each other to increase the probability of completing an electrical path between them. The resistance of the rock between the wells, e.g., may range from 100-10000 ohms. In one embodiment, the power supplied is at a frequency for which the electrical spacing between the electrodes is on the order of 1/10 wavelength or less in the body of the formation, ensuring an electric field that is between the pipe electrodes, e.g., as in a two wire transmission line.

In another embodiment, the electrode is in the order of a ¼ wavelength or multiples of a ¼ wavelength in length, such as to produce multiple voltage nodes or maxima along the electrode.

The high voltage energy of continuous waveform or of any arbitrary waveforms including pulsed waveforms can be produced by a generator which contains impedance and phase adjusting elements, and which supplies energy to the cables or pipes at the wellhead. As high voltage electricity is applied, the underground temperature in the area of the channel between the electrodes will exceed 300° F. in one embodiment, at least 500° F. in a second embodiment, and over 1000° F. in a third embodiment depending on electrode depth related to overburden pressure The high temperatures in one embodiment causes the connate water to expand resulting in fractures in the rock formation with low porosity/permeability, with pressure being released on the compressed rock by the opening of passages by fracturing.

The application of high voltage in the preconditioning step induces an electrical field between the opposite electrode contact points, and with continued application of high voltage electricity, a flow of current commences which creates a plasma arc at the contact in the formation for both electrodes, as the electricity tries to establish a better conducting path. Burning its way through the rock from either electrode, the highly conductive paths are created by these plasma arcs as they advance towards each other. The arcing continues until the two paths meet, leaving a highly conductive path between the electrodes. Additional conductive paths can be made by adjustment of electrode locations.

Current flow through the rock is initially very low at the beginning of this process step, e.g., in the ampere range, and continuously increases as the highly conductive path is created. At a time when the highly conductive paths connect, the current flow increases rapidly approaching a "short circuit" condition wherein essentially from a few ohms to several thousand ohms of electrical impedance is encountered, indicating that pre-conditioning step to generate the highly conductive path is complete.

In one embodiment, the electrodes are disconnected from the high voltage transformer of the pre-conditioning step, and connected to an electrical system capable of generating a high current single waveform shaped of current of short time duration with specific rise and fall time and variable repetition rate. In one embodiment, the electrical system comprises a high voltage cascading capacitor bank that can discharge high voltage electrical energy in a very short period of time, e.g., with duration of the pulse of 1,000 ns to 1,000,000 ns in one embodiment; from 10,000 to 500,000 ns in a second embodiment. The capacitor bank can be rapidly charged and discharged to send a high energy electrical pulse through the electrodes, which is then applied to the highly conductive path through the rock formed in the first part of the process.

Electrical System: In one embodiment, the electrical system is a surface system, comprising an impulse voltage generator, e.g., a Marx generator that can generate output from 100 kV to 2 megavolts of pulsed high voltage and output energy from 10-1000 kJ. An example of a Marx generator is disclosed in US Patent Publication No. 20110065161, incorporated herein by reference in its entirety. Pulsed high voltage generator is light weight and portable. Its modularity lends itself especially to field operations. A multi-stage Marx generator works by charging the capacitors through the charging resistors R'L with a rectified high voltage AC source in the form of a step-up transformer. The triggering of the first stage spark gap is initiated by a high voltage trigger electrode built into one of the spark gap spheres. The transient overvoltage and the UV radiation as a result of the first stage triggering causes the rest of the stages to trigger in rapid succession with very little time delay.

In one embodiment, the electrical system includes a high voltage DC power supply, which charges an energy storage component, such as a capacitor bank storing energy for delivery to the electrodes, e.g., between about 1-50 kJ (kilo joules) in one embodiment, between 50-100 kJ in a second embodiment, and between 100-500 kJ in a third embodiment. A high voltage switch is actuatable in order to discharge the capacitor bank and send energy to the electrodes. A secondary electrical system may be employed to provide pulsed power and actuated at a relatively higher frequency (e.g., in the kHz range) than the primary electrical system. The amount of stored energy released into the channels that has been preconditioned depends on the charging voltage, the capacitance, the series resistance of the impulse voltage generator, and the volume conductivity of the formation.

In one embodiment, the current waveform is of many shapes of intensity determined from surface impedance measurements made by a network analyzer, e.g., over a range of frequencies from 60 Hz to 10 MHz bandwidth, for a pulse waveform that delivers the most energy to the channel.

In one example of the energy delivery requirement of the impulse source, a 600 ampere peak current derived from a 600 kV impulse voltage source having a 1000 ohm source resistance is applied. After the AC preconditioning and for a final conductivity of the channel of 20 ohms over an electrode separation distance of two wire configurations of 112 feet, the peak power delivered to the channel is 7.2 megawatts. Assuming for example a conductive channel which is straight and perpendicular between opposite electrodes, a current impulse of 100 microseconds duration may deliver 720 Joules of energy or 21 Joules per meter channel length. With such localized power density, the channel explodes from plasma energy deposition with attendant rock disintegration and fracturing. In one embodiment with heavy carbon development in the channel, the effective electrical conductivity can be as high as 10,000 S/m, creating more intensive plasma conditions, rock fracture and disintegrations.

Applications: The inventive method is suitable for different types of formations, e.g., tight gas, shale gas, tight oil, tight carbonate, diatomite, geothermal, coalbed methane, methane hydrate containing formations, mineral containing formations, metal containing formations, formations containing inorganic materials in general, bedrocks of very low permeability in the range of 0.01 microdarcy to 10 millidarcy, etc. In one embodiment, it is employed for rock with naturally occurring fractures containing free water or pore water, which may deter or create unintended electrical pathways between the contact electrodes and other electrical grounds. In one embodiment, the method is used for shale or natural gas shale formation, including tight rock formation with low permeability, e.g., Colorado oil shale as field tested by Melton and Cross, which has little or no measureable permeability.

In one embodiment, the method is used for formations rich in oil shale, e.g., more than 35 gallons of oil per ton of rock (GPT), having a high kerogen content compared to a lean shale formation averaging 10 GPT. With high GPT shale rock formations, more carbon can be created for the conductive path.

In one embodiment with intrinsically high carbon formations, the preconditioning AC power could be increased with less impulse power needed. In embodiments with zero or low carbon content formations, the impulse waveform would be the energy driver to achieve fracture through plasma induced rock disintegration. The volume of the formation to be fractured by high voltage, high current waveforms) can be defined by the location of electrode boreholes and their ability to produce highly focused concentrations of electric field energy.

In the electrical fracture method for subsurface rock formations, it is theorized here that pore volumes of adequate size containing connate water can provide highly conductive electrical plasma conditions similar to the burning water phenomena except at subcritical and supercritical temperatures and pressures. By control of both temperature and pressure, the connate water in pore volumes can be quickly heated with electromagnetic energy to temperatures into the supercritical fluid range (starting at ~374 C and 100 bar or 100 kPa), whereby the hydrogen bonds of the water are destroyed, resulting in hydrogen and hydroxide ions and gases. Under which conditions, shock waves are created from supercritical water plasma.

In one embodiment, the method is used for rock fracture in geothermal reservoirs under near supercritical fluid conditions (the supercritical fluid point for water is 3225.9 psi or 222.42 bar and 374.4° C.), practically optimizing the water electrical properties. The waters at this depth have the chemical properties of near supercritical fluids which involve hydronium ions, hydroxide ions and free electrons. Application of impulsive electromagnetic energy by electrodes would create plasma shock waves from the very high current densities that can be induced in these waters. Such shock waves would create fracture.

An example of such geothermal formation include the geothermal fields of Iceland with reservoir pressures in excess of 200 bar and temperatures in excess of 300° C. at depths >2000 meters. Water at such depths and corresponding high temperature is considered a supercritical fluid because of the very weak hydrogen bonding at 22 MPa and 374° C. Supercritical fluids are rich in ions (hydronium and hydroxide ions), are therefore high in electrical conductivity. The supercritical conditions and properties allow plasma shock waves in water to be quickly developed with high energy electrical pulses, resulting in rock disintegration and fracture. The explosive forces of sudden plasma creation in geothermal formations using electromagnetic methods allows energy efficient fracturing with down hole electrode installations for implementing controlled and directed fracturing.

It has been demonstrated that ion product of water rises to $10^{-11}$ in sub-critical condition, while it is $10^{14}$ in atmospheric condition. Thus, the method is also suitable for formation with water under subcritical conditions (also high in ion content) to cause rock disintegration and fracture, with the formation of active species (e.g., H, OH, ions, free electrons) which are unstable molecules with high ionic reactivity.

In one embodiment, the method is used for hydrocarbon recovery in new reservoirs to generate fractures for subsequent recovery of hydrocarbons. It can also be used in mature fields to help improve recovery, e.g., creating pathways for subsequent waterflooding, steamflooding, or fireflooding. Produced hydrocarbons can be natural gas, oil, condensate, or combinations thereof. Mature fields are broadly defined as hydrocarbon fields where production has already peaked and is currently declining.

In another embodiment, the method is used for geothermal applications, generating fractures/pathways in the hot rocks, followed by the injection/pumping of water (or brine) into the formation for circulation through the fractures, and subsequent recovery of steam/hot water from the geothermal hot formation.

In yet another embodiment, the method is used in mining applications. In some embodiments, the method is used in instances of coal mining where the coal lacks permeability. In highly impermeable coal formations, the method is employed to generate "controlled" fractures through the strata in which the boreholes with electrodes are situated to generate new coal seams.

In one embodiment, the method is applicable for solution mining applications. Many minerals are particularly suitable for recovery by thermal solutions flowing through rock fractures. For example, host rocks for some minerals such as sulfide ore deposits have very low permeability. Major fractures with high flow channels may short circuit the solution. The method facilitates many "controlled" fractures in terms of pattern, size, and length in the appropriate strata, to channel the flow of thermal solutions to maximize mineral recovery.

In one embodiment for the extraction of metals such as copper, it is believed that in the method with the high voltage pre-conditioning and pulsing to create the conductive channel(s) and fractures within and about the channel(s), the metals to be extracted react with minerals in the formation to generate chemical complexes which facilitate the mining process.

In some embodiments of mining applications, e.g., metals including precious metals, minerals, inorganic materials, etc., the method can be employed to change the characteristics of the materials to be extracted from the formation, for the generation of materials of economic values. In other mining applications, the method is a "pre-treating" step, employed to fracture and weaken the strength of rocks with boreholes of shallow depth, optionally followed by dousing of the formation and the fractures with solutions to further weaken the formation, after which mining can be initiated or continued. When hard rock surface is reached, the method can be used again to weaken or "pre-treat" the rock, followed by mining, followed by the "pre-treatment" if more hard rock is encountered, so on and so forth.

The method is applicable for environmental remediation. For example, the recovery of certain light non-aqueous phase liquid (LNAPL) materials such as benzene, toluene, xylene, etc. can be challenging in complex fracture bedrock sites, e.g., granite, due to the very low permeability and pore volumes. LNAPL migration and distribution in bedrock is primarily governed by fracture properties, such as orientation, aperture and interconnectivity, with matrix porosity and hydrogeology also playing important roles. Vertical or high angle fractures typically serve as the primary conduits for flow through the unsaturated zone to the water table. When vertical fractures intersect horizontal fractures, LNAPL will spread laterally. If LNAPL thicknesses and vertical fracture apertures are great enough, then LNAPL can migrate below the water table. Significant changes in groundwater elevations, due to pumping, seasonal, or tidal influences, can also result in entrapment of LNAPL below the water table. In one embodiment, the method is used to create fractures to channel the flow of LNAPL into "controlled" pathways or openings in the rock. In yet another embodiment, the method is used to create fractures to generate permeable pathways to allow special chemicals to migrate into source region containing undesirable materials, whether in liquid or solid form, for desorption of the materials from the bed rock interfaces.

Down-hole Diagnostic: Examination of the downhole fractures in one embodiment can be made with a borehole radar as disclosed in USGS Fact Sheet 054-00 with a publication date of May 2000, publication titled "Fracture Characterization Using Borehole Radar" as published in Water, Air, and Soil Pollution: Focus (2006) 6: 17-34; a system and method as disclosed in US Patent Publication No. 20140032116A1 ("Multicomponent borehole radar systems and methods"), or a short-range borehole radar as disclosed in PCT Patent Publication No. WO 2013149308 A1, which references are incorporated herein by reference.

In one embodiment, the borehole-radar reflection method provides information on the location, orientation, and lateral extent of fracture zones that intersect the borehole, and can identify fractures in the rock surrounding the borehole that are not penetrated by drilling. The cross-hole radar logging provides cross-sectional maps of the electromagnetic properties of bedrock between boreholes, which can be used to identify fracture zones (as shown in FIG. 9) and lithologic changes. The borehole-radar logs can be integrated with results of surface-geophysical surveys and other borehole-geophysical logs, such as acoustic or optical televiewer and flowmeter, to distinguish transmissive fractures from lithologic variations or closed fractures. In one embodiment, the borehole radar is used to gather information related to any of distribution, size of fracture and propagation velocity about the multiple fractures generated in the formation.

In the borehole-radar reflection method, one or more sets of transmit and receive antennas are lowered down an open or cased borehole and each of two sets may be positioned above and below the electrode. A radar pulse is transmitted into the bedrock surrounding the borehole. The transmitted pulse moves away from the borehole until it encounters material with different electromagnetic properties, e.g., a fracture zone, change in rock type, or a void. A radar reflection profile along the borehole can be created by taking a radar scan at each position as the antennas are moved up or down the borehole. Radar reflection logging can be conducted with omni-directional or directional receiving antennas.

EXAMPLE

The example is given to illustrate the invention. However, the invention is not limited to the specific conditions or details described in the example.

In the pilot test, a two parallel horizontal borehole system giving a distribution of the electric fields as in a two-wire transmission line system was employed in an oil shale formation. The system employed high voltage AC and impulse energy for rock fracture. The wire or conductor (could be flexible or rigid) transferred the high voltage currents in borehole to the required depth, with electrical contact at the distal end of the downhole assembly, and with dielectric sleeve on the conductor over its entire length except at the contact point to isolate voltages from the non-contact portions of the conductor.

Figure 7:
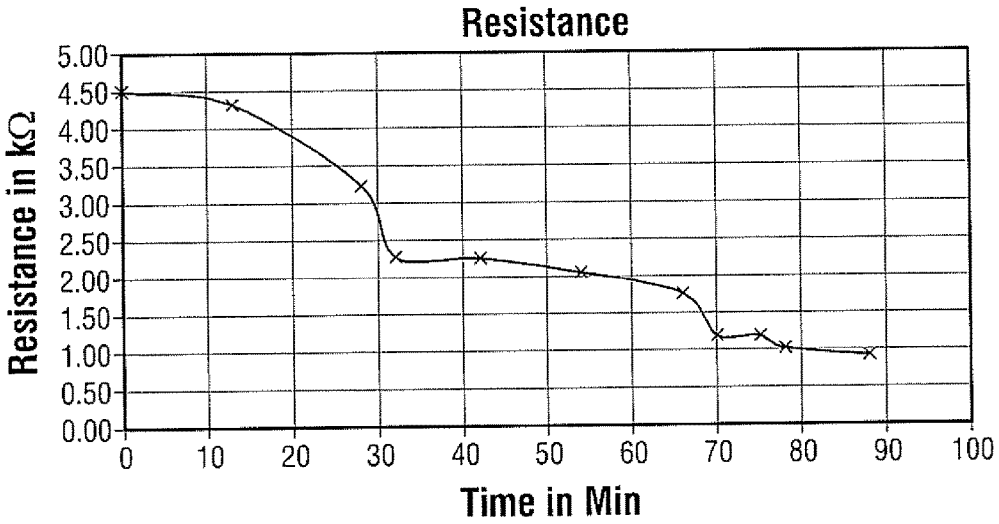
FIG. 7 is a graph showing the change in initial resistance or resistivity as a function of time for the pilot test.
Figure 8:
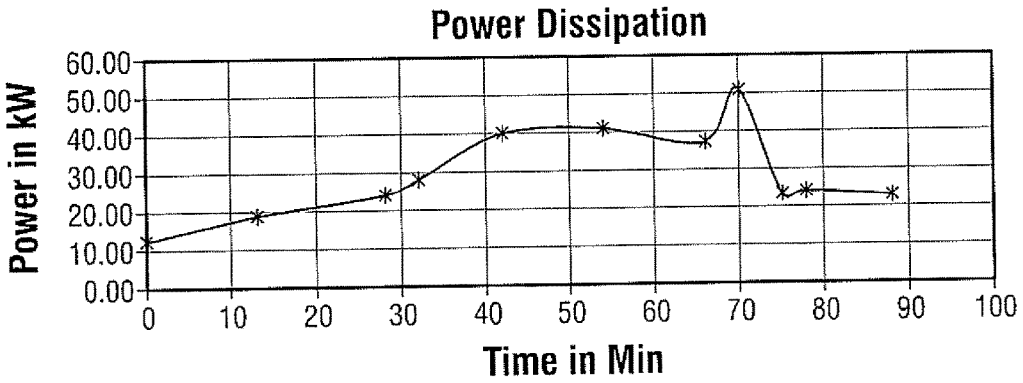
FIG. 8 is a graph showing the power dissipation as a function of time for the pilot test.

Immediately following AC pre-conditioning, a maximum of 40 kilojoules of electrical energy was delivered every minute at peak voltages of 800,000 volts to the formation. Measureable fracture pathways were created up to electrode spacings of over 150 feet. Significant permeability enhancement was measured after several hours of energy application by the combination of AC preconditioning and high voltage impulse cycling. As the high voltage discharge burned through the formation between the point electrodes, the initial resistance decreased with time from 4.5 kΩ to values less than 1 kΩ as illustrated in FIG. 7. The power dissipation is as illustrated in FIG. 8.

Reference will be made to the Figures, showing various embodiments of the invention.

FIG. 1 illustrates a system in which secondary (point) electrodes are employed to generate high electric field intensities to initiate electron avalanching and voltage breakdown at selected points along the electrode. Positioned in a formation and extending through the overburden are a plurality of electrode structures, spaced apart therein which as is show here by way of example, as a two wire transmission line configuration. The high voltage (HV) hollow or solid pipe or cable (76) is located inside a metal casing (78) and insulated from it by insulators (80, 82). The distal end of the cable is electrically connected to a hollow metal pipe or active electrode having multiple point electrodes (70) on its surface. The proximal end of the HV cable end is connected to the HV generator (92), which is a step-up high voltage transformer with oil or SF6 as insulating medium. The output is regulated on the primary side of the transformer with variable transformer or phase controlled SCR (silicon control rectifiers). The point electrodes greatly amplify the radial electric field intensity at specific points along the active electrode. These point electrodes initiate an electron avalanche condition in the adjacent formation with resulting ionization and voltage breakdown that propagates along high concentration lines of flux of electric field intensity between boreholes.

The metal casings (78) are spaced apart by a distance in the formation, determined by the characteristics of the rock related to the dielectric and physical properties and the frequency to be used for preconditioning. In one embodiment, low frequencies are employed, e.g., 50 Hz-50 kHz, for preconditioning by a generator operating as a high voltage continuous wave source of energy. For example, if 60 Hz is to be used, spacing on the order of 125 to 200 feet is desirable. Other spacing's may be used depending on drilling expense as well as other factors. In one embodiment to reduce undesirable radiation of electromagnetic energy in the formation, the active electrode spacing is less than ⅛ wavelength in the formation, such that the active electrodes may be energized in phase opposition to produce captive electric fields between the casings (78).

The portion of the HV cable or pipe inside the casing (78) and insulated from it creates shielding and grounding for the high voltage. A metallic screen (94) may be used positioned on the ground intermediate to the casings (78) and a ground connection from the generator for system grounding purposes. At high frequencies such as 1 MHz, it may also help to reduce any stray radiation from casings (78).

In one embodiment, the generator (impulse current generator) is a Marx generator, with output from hundreds of kilovolts to megavolts of pulsed high voltage into a low resistance load (after preconditioning) based on the principle of parallel charging of capacitor banks and then series discharging through triggered spark gaps. The preconditioned volume of conductive material allows high currents to be efficiently transmitted from electrode to electrode for the creation of intense shock waves that result in rock disintegration of minerals, pyrolysis of organic materials, and physical expansion of the formation resulting in multiple fracturing.

Figure 2:
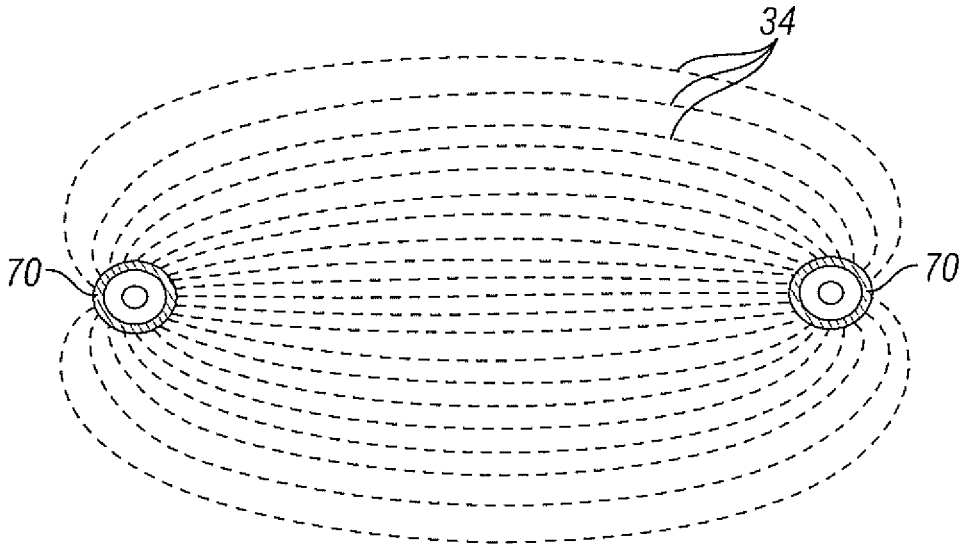
FIG. 2 illustrates the electric field concentrate along the channel between the two electrodes.

FIG. 2 illustrates the electric field concentrate along the channel between the two electrodes. As shown, the electric field of the active electrode concentrates immediately adjacent the active electrodes (70) and is reduced by distance away from the casings (78). The maximum concentrations will exist at the tip of the point electrodes on active electrodes (70) and indicated by the high density of electric field flux lines between casings. The wave fronts of ionization will tend to follow within this high density of flux line region (34). Low ionizable gas injections from ports at or near the point electrodes will assist in creating ionization pathways between the electrodes.

By supplying sufficient electric energy to create the ionization pathways between casings (78), formation physical changes (e.g., micro fracturing and localized rock disintegration) and high formation electrical conductivity develops in the regions of the propagating electrical discharge or ionization between casings (78). Low transmission line impedance will be measureable at the input to the cable or pipe where the generator connection is made corresponding to the increasing conductivity. The regions of high formation electrical conductivities are variable based on the locations of the point electrodes (70) along the active electrodes surfaces.

Figure 3:
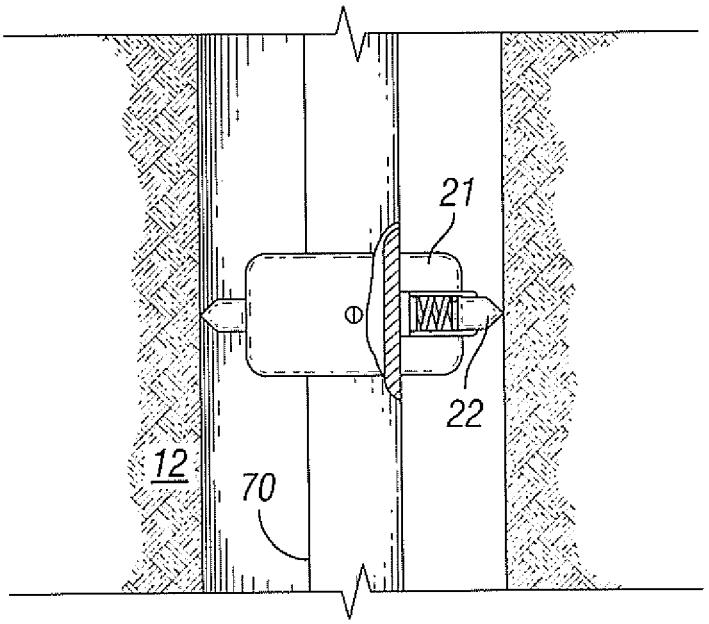
FIG. 3 illustrates an embodiment of an electrode enhanced with secondary electrode in the form of a metal point.

FIG. 3 illustrates an embodiment of an electrode enhanced with secondary electrode in the form of a metal point with spring loaded pins. The active electrode (70) is shown in a position in borehole (12). A spring loaded pin (21) insures a pressure contact against the opposite side of the borehole wall with pin (22), sufficient for high voltage electrical discharge into the formation from local electric field enhancement by the pin geometry.

Figure 4:
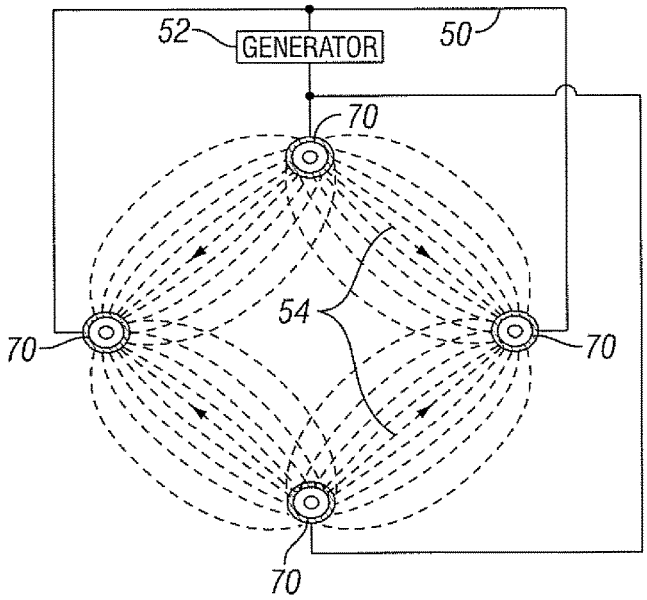
FIG. 4 illustrates an embodiment of a four-electrode structure.

Referring to FIG. 4, there is shown a section of a four-electrode structure to expand on a two-hole fracture layout of FIG. 1, wherein the electrodes can be generally of the same type. In one embodiment, the electrodes are positioned on the corners of a square and energy is delivered as indicated diagrammatically by wires (50) out of phase from a HV generator (52). The generator includes impedance matching and phase matching structures to opposite corners of the square or four spot pattern of electrodes, so that adjacent electrodes along each side of the square are fed out of phase with energy and produce electric fields at a given distance with arrows (54) as shown. Such a pattern is made more uniform over the field pattern shown in FIG. 2, allowing for a greater volume of preconditioning with a more uniform increase in electrical conductivity. In one embodiment with secondary (point) electrodes, the secondary electrodes can greatly enhanced electric field intensities at the electrode surface at the points where they make contact with the formation.

It should be noted that different electrode patterns can be employed other than the two- and four-electrode structures as shown. A plurality of the same or different patterns can be employed. Some or all of the electrodes can be further enhanced with the secondary (point) electrodes along the length of the active electrode surfaces. The secondary electrodes can be spaced at equal or variable distance along the electrode lengths, and distance between each pair of electrodes can be the same or different, depending on the desired fracture patterns for the formation.

Figure 5:
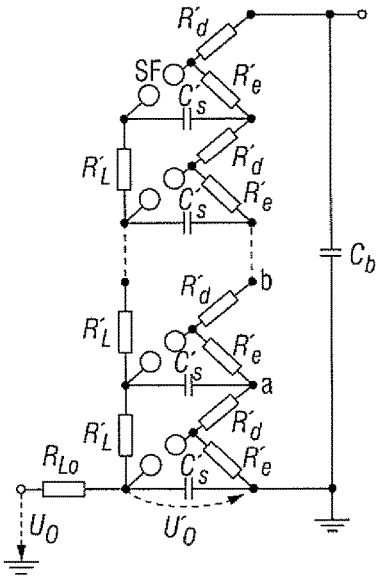
FIG. 5 is a circuit diagram illustrating an embodiment of a multi-stage impulse voltage generator.

FIG. 5 is a circuit diagram illustrating an embodiment of a multi-stage impulse voltage generator. Depending on the number of stages, the generator can deliver 100-2000 kV peak pulsed output voltage of a double exponential waveforms with varying rise and fall times, with total stored energy ranging from 10-1000 kJ. In one embodiment, each stage consists of a 100 kV, 1 μF capacity C's, a spark gap switch in high pressure SF6 gas, charging resistor R'L, series resistor R'd and parallel resistor R'e. By varying the resistance and the load capacitance, the output waveforms can be changed with the output voltage being a function of the charging voltage.

Figure 6:
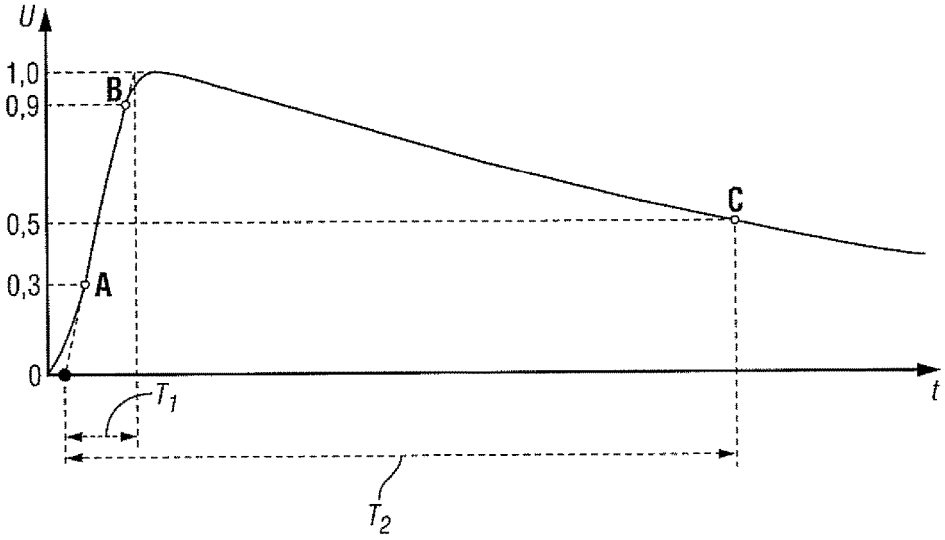
FIG. 6 is graph illustrating a standard full lightning impulse voltage.

FIG. 6 is a graph showing a standard lightning impulse voltage waveform for one embodiment, in which the voltage rises to its peak value u in a minimum amount of time, e.g., a rise (front) time of 1.2 μs, and falls appreciably slower to a half-value (tail) of 50 μs, and ultimately back to 0, for a 1.2/50 impulse voltage.

Figure 10A:
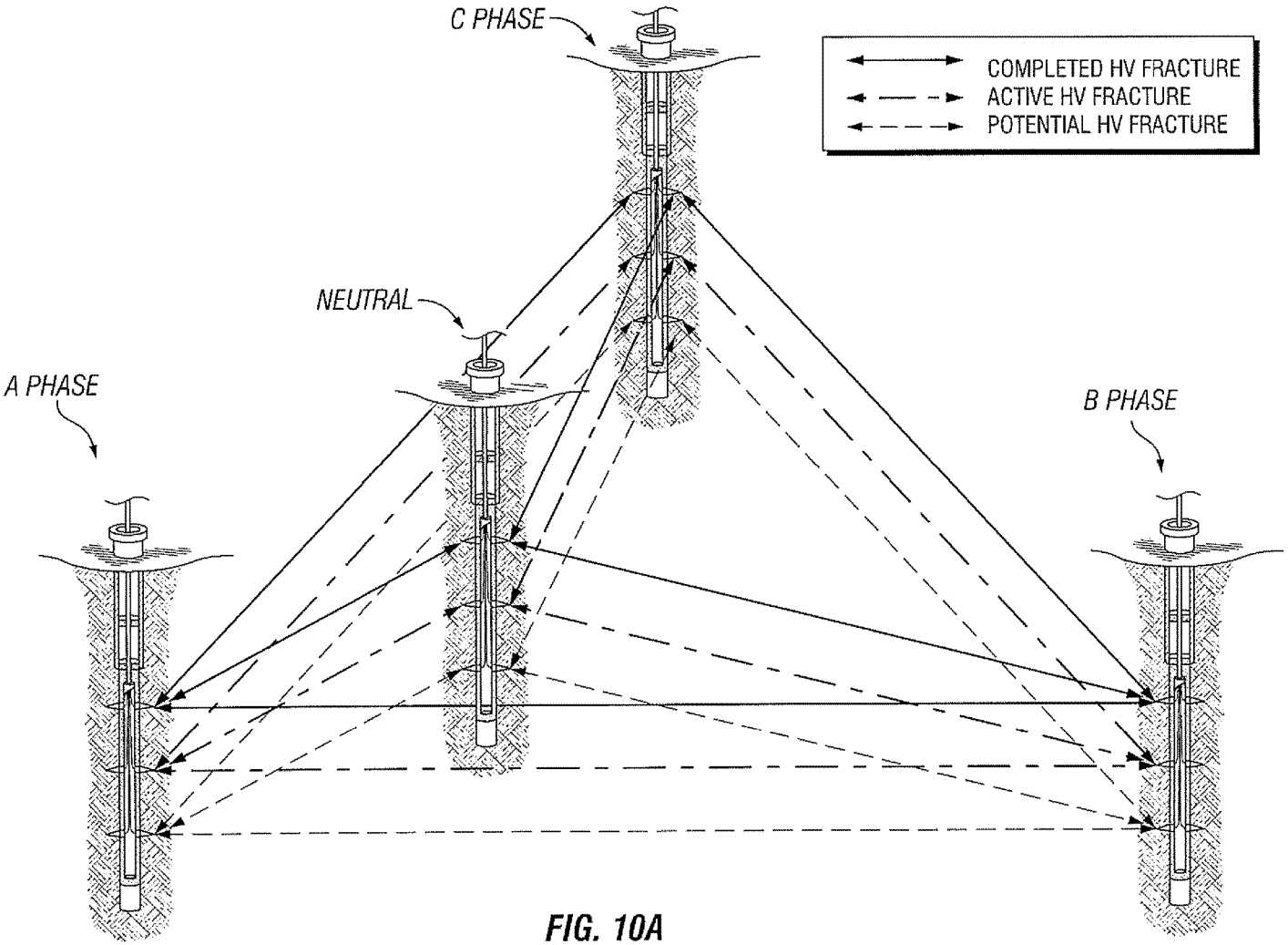
FIG. 10A illustrates an embodiment of a system of the invention using a multiphase configuration, specifically three phases.
Figure 10B:
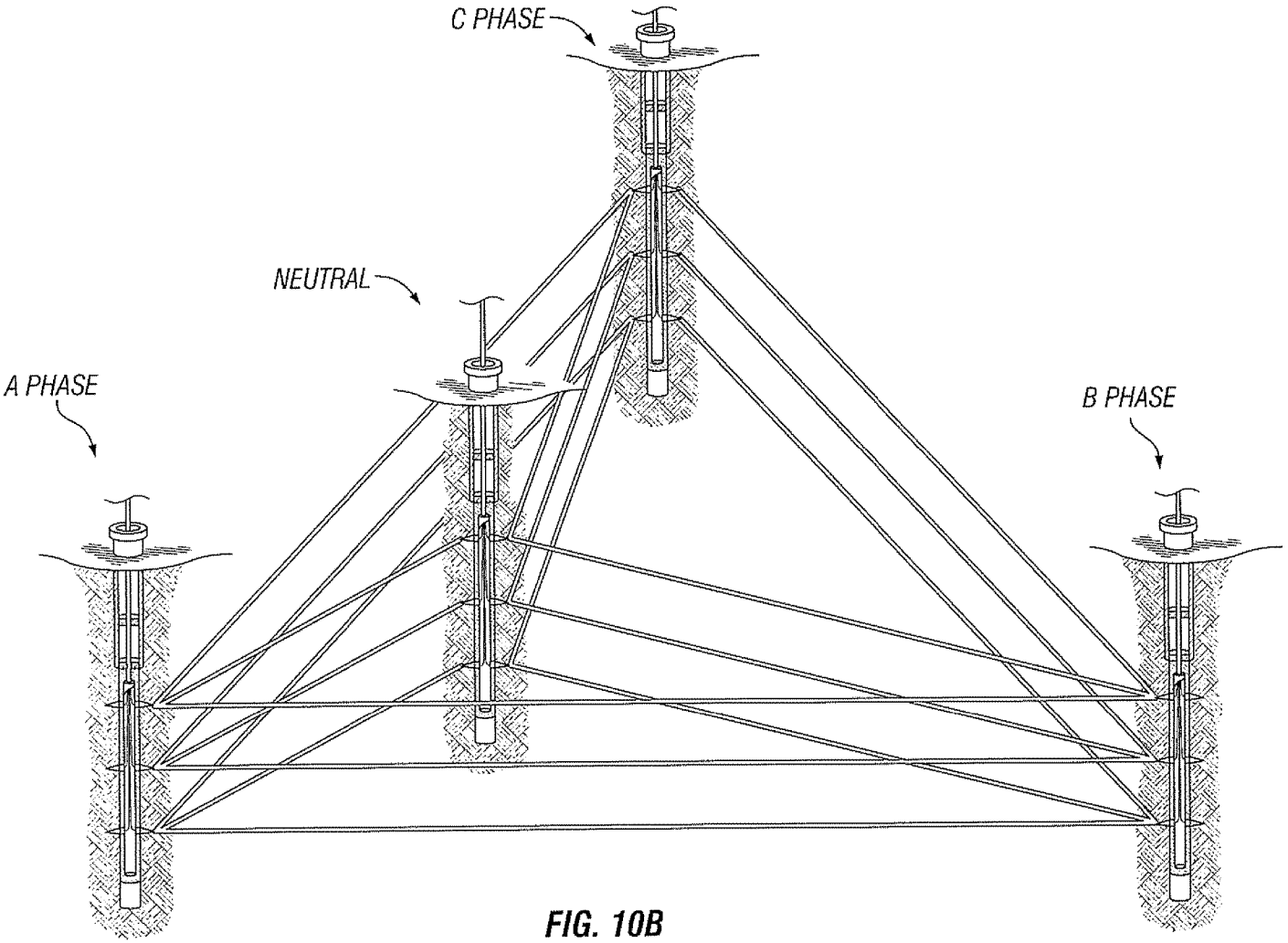
FIG. 10B illustrates the embodiment of FIG. 10B with completed fractures.

FIG. 1 illustrates an embodiment of a system of the invention using a single phase configuration. FIG. 10A illustrates an embodiment of a system of the invention using a multiphase configuration, specifically three phases, and more specifically three phase Wye. FIG. 10B illustrates the embodiment of FIG. 10A with completed fractures. FIGS. 10A-10B are consistent with the equipment and borehole shown in FIG. 1, and includes a neutral and three electrical phases (i.e., phase A, phase B, and phase C).

Energy may be applied using a single phase configuration, a multiphase configuration, or any combination thereof. For avoidance of doubt, some embodiments may only use a configuration that is: single phase configuration. For example, the energy may be applied using at least one single phase configuration. For avoidance of doubt, some embodiments may only use a configuration that is: multiphase configuration. For example, the energy may be applied using at least one multiphase configuration. For avoidance of doubt, some embodiments may use both types of configurations: single phase configuration and multiphase configuration. For example, the energy may be applied using at least one single phase configuration and at least one multiphase configuration.

For avoidance of doubt, a plurality of single phase configurations may be utilized in some embodiments. For example, the energy may be applied using a first single phase configuration and at least one other single phase configuration, such as to fracture a large area at a substantially same time. As an example, the plurality of single phase configurations may be setup as a plurality of the embodiment of FIG. 1 in isolation. In one embodiment, the terminology "substantially same time" indicates that at least 80% of the fractures are generated in two hours or less.

For avoidance of doubt, the multiphase configuration may be accomplished in a variety of ways. For example, the multiphase configuration may comprise three phases, six phases, nine phases, or twelve phases. For example, the multiphase configuration may comprise a plurality of three phases (e.g., multiples of 3 phases). For example, the multiphase configuration may comprise three phase Delta, three phase Wye, or any combination thereof. Three phase Delta comprises, for example, a phase A, a phase B, and a phase C. Three phase Wye comprises, for example, a neutral and a phase A, a phase B, and a phase C. In one embodiment, energy may be applied using three phase Delta, three phase Wye, or any combination thereof, such as to allow stimulation of multiple wells at a substantially same time to generate multiple controlled fractures at a substantially same time. In one embodiment, the terminology "substantially same time" indicates that at least 80% of the fractures are generated in two hours or less. However, it may be advantageous to power off certain phases during the multiphase application period to create a more desirable set of fractures based on impedance measurements. Thus, the multiphase configuration may be used for generating the multiple controlled fractures in a time sequence other than a substantially same time. As an example, if the impedance measurements by the network analyzer do not show a reduction in ohms for a particular phase, then that particular phase may be shut down and/or at least one other phase may be added to boost power input.

An example of the multiphase configuration includes duplicating the embodiment of FIG. 10A such that two three phases are connected, specifically the two neutrals are connected to each other, the two phase A's are connected to each other, the two phase B's are connected to each other, etc. Alternatively, in some embodiments, six phases (e.g., phases A-F) are all connected to one neutral. In some embodiments, each setup of three phases has at least one generator with four leeds. Alternatively, the generator can provide power to a plurality of three phase setups. Thus, a plurality of the embodiment of FIG. 10A may be used to create a multiphase configuration. Furthermore, some embodiments only include a multiphase configuration that is three phase Delta. Some embodiments only include a multiphase configuration that is three phase Wye. In some embodiments, a three phase Delta setup and a three phase Wye setup may be combined.

Those of ordinary skill in the art will appreciate that other options are possible and the configurations and combinations provided herein are not exhaustive. Indeed, controlled fractures may be generated based on a variety of factors, including the configuration that the energy is applied (e.g., multiphase configuration, etc.), the electrodes (and the electric field(s) they generate) that define a fracture pattern for the geologic formation, etc.

Various options may also be available for the preconditioning portion. For example, in some embodiments, generation of the conductive channel is complete when current flow measured by a network analyzer exhibits a measured reduction of channel resistance of 90% ohms or more in 6 hours or less from when first applying the sufficient amount of energy comprising AC power to the electrodes. The starting channel resistance may be measured by the network analyzer. As an example, the network analyzer may indicate that the starting channel resistance is 10,000 ohms, and after preconditioning, the network analyzer may indicate that the channel resistance is 1,000 ohms, which is a measured reduction of channel resistance of 90% ohms. Alternatively, the network analyzer may indicate that the channel resistance is 500 ohms, 250 ohms, or 100 ohms, etc., each of which is a measured reduction of channel resistance of 90% ohms or more. The measured reduction may depend on the spacing of the electrodes, the type of formation, hydrocarbon content of the formation, and other factors. In a plot of resistance versus time, on the average, it will be desirable to see a drop of resistance versus increasing time. Regarding timing, in some embodiments, it may be 5 hours or less. In some embodiments, it may be 4 hours or less. In some embodiments, it may be 3 hours or less. In some embodiments, it may be 2 hours or less. In some embodiments, it may be 1 hour or less.

In another example, generation of the conductive channel is complete when current flow measured by a network analyzer exhibits a measured reduction of channel resistance of 3.5Ω or more in less than 90 minutes from when first applying the sufficient amount of energy comprising AC power to the electrodes.

The claimed subject matter is not to be limited in scope by the specific embodiments described herein. Indeed, various modifications of one or more embodiments disclosed herein in addition to those described herein will become apparent to those skilled in the art from the foregoing descriptions. Such modifications are intended to fall within the scope of the appended claims.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

Unless defined otherwise, all technical and scientific terms used herein have the same meanings as commonly understood by one of skill in the art to which the disclosed invention belongs.

For the avoidance of doubt, the present application includes the subject-matter defined in the following numbered paragraphs:

Claim 1A: A method for remediating accumulations of materials from a bed rock formation having low permeability, the method comprising:

providing a plurality of boreholes in the formation;

placing a plurality of electrodes in the boreholes with one electrode per borehole, with the plurality of electrodes defining a fracture pattern for the geologic formation;

applying a sufficient amount of energy to the electrodes to generate a least a conductive channel between a pair of electrodes, wherein the conductivity in the channel between the pair of electrodes is defined has a ratio of final to initial channel conductivity of 10:1 to 50,000:1; and applying electrical impulses to the electrodes, the electrical impulses having a voltage output ranging from 100-2000 kV, an energy output of 10-1000 kJ, wherein the pulses have a rise time ranging from 0.05-500 microseconds and a half-value time of 50-5000 microseconds; wherein the application of the electrical pulses generates multiple fractures within and about the conductive channel by disintegration of minerals and pyrolysis of organic materials in the formation, forming pathways in the bed rock.

Claim 2A: The method for remediation of claim 1, further comprising channeling the materials into the pathways created by the multiple fractures of the defined fracture pattern.

Claim 3A: The method for remediation of claim 1, further comprising:

providing at least an additive for desorption of or mobilization of the materials;

channeling the additive into the permeable pathways created by the multiple fractures.

Claim 4B: The method of claim 3, wherein the additive is selected from: steam, gas, a liquid chemical, solid particles, and combinations thereof.

Claim 5A: A method for extracting ores from a geologic formation, the method comprising:

providing a plurality of boreholes in the formation;

placing a plurality of electrodes in the boreholes with one electrode per borehole, with the plurality of electrodes defining a fracture pattern for the geologic formation;

applying a sufficient amount of energy to the electrodes to generate a least a conductive channel between a pair of electrodes, wherein the conductivity in the channel between the pair of electrodes is defined has a ratio of final to initial channel conductivity of 10:1 to 50,000:1;

applying electrical impulses to the electrodes, the electrical impulses having a voltage output ranging from 100-2000 kV, an energy output of 10-1000 kJ, wherein the pulses have a rise time ranging from 0.05-500 microseconds and a half-value time of 50-5000 microseconds; wherein the application of the electrical pulses generates multiple fractures within and about the conductive channel by disintegration of minerals and pyrolysis of organic materials in the formation, forming pathways in the formation;

injecting at least a solution into the formation through the pathways created by the multiple fractures; and recovering ores from the formation.

Claim 6A: The method of claim 5, wherein the ores comprise any of metals, minerals, inorganic materials, organic materials, and combinations thereof.

Claim 7A: A method for recovering geothermal energy from a geothermal formation, the method comprising:

providing a plurality of boreholes in the formation;

placing a plurality of electrodes in the boreholes with one electrode per borehole, with the plurality of electrodes defining a fracture pattern for the geologic formation;

applying a sufficient amount of energy to the electrodes to generate a least a conductive channel between a pair of electrodes, wherein the conductivity in the channel between the pair of electrodes is defined has a ratio of final to initial channel conductivity of 10:1 to 50,000:1;

applying electrical impulses to the electrodes, the electrical impulses having a voltage output ranging from 100-2000 kV, an energy output of 10-1000 kJ, wherein the pulses have a rise time ranging from 0.05-500 microseconds and a half-value time of 50-5000 microseconds; wherein the application of the electrical pulses generates multiple fractures within and about the conductive channel by disintegration of minerals and pyrolysis of organic materials in the formation, forming pathways in the formation; and recovering any of steam, heated water, and combinations thereof from the formation.

Claim 8A: The method of claim 7, prior to recovering any of steam, heated water, and combinations thereof from the formation, further comprising injecting water into the formation through the pathways created by the multiple fractures for the water to be heated by the geothermal formation.

Claim 1B: A method of generating fractures in geologic formation, the method comprising:

providing a plurality of boreholes in the formation;

placing a plurality of electrodes in the boreholes with one electrode per borehole, with the plurality of electrodes defining a fracture pattern for the geologic formation;

applying a sufficient amount of energy to the electrodes to generate a least a conductive channel between a pair of electrodes, wherein the conductivity in the channel between the pair of electrodes is defined has a ratio of final to initial channel conductivity of 10:1 to 50,000:1; and applying electrical impulses to the electrodes, the electrical impulses having a voltage output ranging from 100-2000 kV, an energy output of 10-1000 kJ, wherein the pulses have a rise time ranging from 0.05-500 microseconds and a half-value time of 50-5000 microseconds;

wherein the application of the electrical pulses generates multiple fractures within and about the conductive channel by disintegration of minerals and pyrolysis of organic materials in the formation.

Claim 2B. The method of claim 1, wherein the sufficient amount of energy applied to the electrodes to generate the conductive channel is selected from electromagnetic conduction, radiant energy and combinations thereof.

Claim 3B. The method of claim 1, wherein the sufficient amount of energy applied to the electrodes is varied by time phasing of input current or voltage to change energy distribution between the electrodes in the boreholes and thereby controlling the fracturing pattern in the formation.

Claim 4B. The method of claim 1, wherein the sufficient amount of energy ranges from 1 kV to 2 MV at a frequency range of DC to 100 MHz for any of continuous waveforms and pulsed waveforms.

Claim 5B. The method of claim 1 after applying a sufficient amount of energy to each pair of electrodes, further comprising:

measuring volumetric and channel electrical resistance between at least the pair of electrodes of the formation.

Claim 6B. The method of claim 5, wherein the measurement of volumetric electrical resistance is by network analyzer and the measurement of channel electrical resistance is by impedance spectroscopy; and wherein the electrical impulses are applied after the impedance spectroscopy and network analyzers measurements to indicate sufficient reduction of electrical impedance indicating presence of a conductive channel.

Claim 7B. The method of claim 1, wherein each electrode is contained within a borehole wall, and wherein at least one electrode is in contact with borehole wall through a spring loaded pin.

Claim 8B. The method of claim 1, wherein at least one electrode is contained within a borehole wall and the at least one electrode extends into the formation through the borehole wall by telescopically.

Claim 9B. The method of claim 1, wherein a resultant change in volume resistivity of the formation to be fractured is measured between a pair of boreholes by impedance spectroscopy method, with borehole to borehole network analyzer measurement made over a range of frequencies from 60 Hz to 10 MHz to provide Cole-Cole plots of complex dielectric constant to characterize frequencies.

Claim 10B. The method of claim 1, wherein the plurality of electrodes are connected to at least a surface waveform generator, and wherein the generator generates a voltage waveform to provide shock waves causing multiple fractures between the electrodes.

Claim 11B. The method of claim 11, wherein the voltage waveform has a frequency spectrum coinciding with a Cole-Cole plots for complex dielectric constant and Smith Chart plots for complex impedance.

Claim 12B. The method of claim 11, wherein the voltage waveform has a frequency spectrum coinciding with a frequency range of lowest formation resistivity and maximum shock wave effect for fracture.

Claim 13B. The method of claim 11, wherein the voltage waveform exceeds 100 kilovolts in amplitude with a corresponding current exceeding 1000 amperes in magnitude at peak value of a generator output waveform.

Claim 14B. The method of claim 11, wherein the waveform generator is characterized by having a voltage and a current with a plurality of shapes selected from pulse, damped sine wave, and exponential decay.

Claim 15B. The method of claim 1, wherein the boreholes are any of vertical boreholes, horizontal boreholes, and combinations thereof to establish required volume of fracture.

Claim 16B. The method of claim 1, wherein each borehole is provided with at least one electrode.

Claim 17B. The method of claim 1, where each borehole is provided with a plurality of electrodes, with the plurality of electrodes being placed at different depths in the borehole.

Claim 18B. The method of claim 1, wherein the plurality of electrodes are connected to at least a surface waveform generator for generating a time sequence of waveforms to generate electric shock wave excitations in the mineral and organic materials in the formation, generating fracture volume in the formation.

Claim 19B. The method of claim 1, wherein at least one of the electrodes further comprises a plurality of secondary electrodes.

Claim 20B. The method of claim 19, wherein the plurality of secondary electrodes are in contact with the formation.

Claim 21B. The method of claim 19, further comprising injecting an easily ionizable gas in the boreholes.

Claim 22B. The method of claim 19, wherein each secondary electrode is insulated from an adjacent secondary electrode.

Claim 23B. The method of claim 19, wherein the plurality of secondary electrodes are placed in casing or open-hole in the boreholes to maximize radial electric field intensity initializing voltage discharge between the plurality of secondary electrodes and the formation.

Claim 24B. The method of claim 1, wherein at least two electrodes are employed in each borehole.

Claim 25B. The method of claim 1, further comprising using a borehole radar to gather information about the multiple fractures generated in the formation.

Claim 26B. The method of claim 25, wherein the borehole radar is used to gather information relating to any of distribution, size of fracture and propagation velocity of the multiple fractures generated in the formation.

Claim 27B. The method of claim 25, wherein the information about the multiple fractures includes any of location, orientation, and lateral extent of fracture zones intersecting the boreholes.

Claim 28B. The method of claim 1, wherein placing the plurality of electrodes in the boreholes comprises positioning the electrodes in the boreholes for forming electrode configurations selected from two-wire transmission line, four-wire transmission line, cage-like transmission line structure, antennas, and combinations thereof.

Claim 29B. A method of generating fractures in a formation containing connate water, the method comprising:

providing a plurality of boreholes in the formation;

placing a plurality of electrodes in the boreholes with one electrode per borehole, with the plurality of electrodes defining a fracture pattern for the geologic formation;

applying a sufficient amount of energy to the electrodes to heat the connate water in the formation to any of subcritical condition or supercritical condition; and applying electrical impulses having a voltage output ranging from 100-2000 kV, an energy output of 10-1000 kJ, wherein the pulses have a rise time ranging from 0.05-500 microseconds and a half-value time of 50-5000 microseconds;

wherein the application of the electrical pulses generates allow plasma shock waves in the water creating multiple fractures in the formation.

Claim 30B. The method of claim 1, wherein the formation is any of tight gas, shale gas, tight oil, tight carbonate, diatomite, geothermal, coalbed methane, methane hydrate containing formation, mineral containing formation, metal containing formation, a bedrock formation having a permeability in the range of 0.01 microdarcy to 10 millidarcy.

Claim 31B. The method of claim 30, wherein the formation contains gas, and wherein the multiple fractures allows pressure in the formation to force recovery of gas contained within the formation.

Claim 32B. The method of claim 30, wherein the formation is a diatomite formation, and further comprising: injecting any of steam and water into the formation and through the multiple fractures; and recovering hydrocarbons from the formation.

Claim 33B. The method of claim 30, wherein the formation is any of a tight gas, a shale gas, or a coalbed methane formation, and further comprising:

injecting a liquid stream into the formation and the multiple fractures; and recovering hydrocarbons from the formation.

Claim 34B. The method of claim 30, wherein the formation is a coalbed methane formation, further comprising:

pumping water out of the formation through the multiple fractures; and recovering methane gas from the formation.

Claim 35B. The method of claim 30, wherein the formation is a geothermal formation, and further comprising:

recovering any of steam, heated water, and combinations thereof from the formation through the multiple fractures.

Claim 36B. The method of claim 34, further comprising:

injecting any of water and steam into the formation into through the multiple fractures for the water to be heated by the geothermal formation.

Claim 1C. A system for generating fractures in geologic formation, the system comprising:

a plurality of electrodes for placing in boreholes in a formation with one electrode per borehole, for the plurality of electrodes to define a fracture pattern for the geologic formation;

a first electrical system for delivering a sufficient amount of energy to the electrodes to generate at least a conductive channel between a pair of electrodes with the conductivity in the channel having a ratio of final to initial channel conductivity of 10:1 to 50,000:1, the sufficient amount of energy applied to the electrodes to generate the conductive channel is selected from electromagnetic conduction, radiant energy and combinations thereof;

a second electrical system for generating electrical impulses with a voltage output ranging from 100-2000 kV, with the pulses having a rise time ranging from 0.05-500 microseconds and a half-value time of 50-5000 microseconds;

wherein the application of the electrical pulses generate multiple fractures surrounding and within the conductive channel by disintegration of minerals and inorganic materials and pyrolysis of organic materials in the formation.

Claim 2C. The system of claim 1, wherein the first electrical system comprises electrical equipment to supply voltages and currents at a pre-select frequency for the fracture pattern.

Claim 3C. The system of claim 1, wherein the sufficient amount of energy applied to the electrodes is varied by time phasing of input current or voltage to change energy distribution between the electrodes in the boreholes and thereby controlling fracturing in the formation.

Claim 4C. The method of claim 1, wherein the sufficient amount of energy ranges from 1 kV to 2 MV at a frequency range of DC to 100 MHz for any of continuous waveforms and pulsed waveforms.

Claim 5C. The system of claim 1, wherein the electrodes are position within the boreholes for forming electrode configurations selected from two-wire transmission line, four-wire transmission line, cage-like-transmission line structure, antennas, and combinations thereof.

Claim 6C. The system of claim 1, wherein each electrode is electrically connected to a cable or a cylinder located within a borehole.

Claim 7C. The system of claim 1, and wherein each electrode is contained within a borehole wall and at least one electrode is in contact with borehole wall through a spring loaded pin.

Claim 8C. The system of claim 1, wherein each electrode is contained within a borehole wall and at least one electrode extends into the formation through the borehole wall by telescopic means.

Claim 9C. The system of claim 1, further comprising an impedance spectroscopy for measuring a resultant change in resistivity of volume of the formation to be fractured between a pair of boreholes.

Claim 10C. The system of claim 1, further comprising a network analyzer for measuring dielectric constant changes over a frequency range from 60 Hz to 10 MHz.

Claim 11C. The system of claim 1, wherein the second electrical system is a waveform generator for generating a voltage waveform to provide shock waves generating the multiple fractures between the electrodes.

Claim 12C. The system of claim 11, wherein the voltage waveform has a frequency spectrum coinciding with a Cole-Cole plots for complex dielectric constant and Smith Chart plots for complex impedance.

Claim 13C. The system of claim 11, wherein the voltage waveform has a frequency spectrum coinciding with a frequency range of lowest formation resistivity and maximum shock wave effect.

Claim 14C. The system of claim 11, wherein the voltage waveform exceeds 100 kilovolts in amplitude with a corresponding current exceeding 1000 amperes in magnitude at peak value of output of the waveform generator.

Claim 15C. The system of claim 11, wherein the waveform generator is characterized by having a voltage and a current with a plurality of shapes varying according to any of pulse, damped sine wave, and exponential decay.

Claim 16C. The system of claim 1, wherein at least one of the electrodes further comprises a plurality of secondary electrodes.

Claim 17C. The system of claim 1, further comprising a plurality of gas injection ports for injecting an easily ionizable gas into the formation.

Claim 18C. The system of claim 1, wherein at least two electrodes are employed in each borehole.

Claim 19C. The system of claim 1, further comprising a borehole radar to gather any of distribution, size of fracture and propagation velocity about the multiple fractures generated in the formation among sets of boreholes.

Claim 20C. The system of claim 1, further comprising a plurality of double packers, with each double packer comprising an upper packer and a lower packer, having at least one electrode disposed between the upper and lower packer defining a compartment for containing at least one electrode.

Claim 21C. The system of claim 20, wherein the packers are inflatable packers.

Claim 22C. The system of claim 20, wherein the compartment defined by the upper and lower packers comprises at least an injection port for injection gas into the formation.

Claim 23C. The system of claim 21, wherein the inflatable packers are made from non-conductive materials.

The invention claimed is:

1. A system for generating controlled fractures in geologic formation, the system comprising:

a plurality of electrodes placed in a formation in a plurality of boreholes, wherein the plurality of electrodes define a fracture pattern for the geologic formation;

a preconditioning generator for delivering energy comprising AC power to the electrodes to generate at least one conductive channel between a pair of electrodes with the conductivity in the channel having a ratio of final to initial channel conductivity of 10:1 to 50,000:1, the energy applied to the electrodes to generate the conductive channel is selected from electromagnetic conduction, radiant energy and combinations thereof;

an impulse generator for generating electrical impulses with a voltage output ranging from 100-2000 kV, with the pulses having a rise time ranging from 0.05-500 microseconds and a half-value time of 50-5000 microseconds;

wherein the application of the electrical pulse generate multiple fractures surrounding and within the conductive channel by disintegration of minerals and inorganic materials and pyrolysis of organic materials in the formation;

wherein the energy to generate the multiple controlled fractures is applied using a multiphase configuration.

2. The system of claim 1, wherein the multiphase configuration comprises three phases, six phases, nine phases, or twelve phases.

3. The system of claim 1, wherein the multiphase configuration comprises a plurality of three phases.

4. The system of claim 1, wherein the multiphase configuration comprises three phase Delta, three phase Wye, or any combination thereof.

5. The system of claim 1, wherein the multiphase configuration results in generating the multiple controlled fractures at a substantially same time.

6. The system of claim 1, wherein the multiphase configuration results in generating the multiple controlled fractures in a time sequence other than a substantially same time.

7. The system of claim 1, wherein a single generator is both the preconditioning generator and the impulse generator.

8. The system of claim 1, wherein the energy to generate the multiple controlled fractures is applied using the multiphase configuration and a single phase configuration.

9. The system of claim 1, wherein the multiphase configuration is not a three phase configuration.

10. A method of generating controlled fractures in geologic formation, the method comprising:

providing a plurality of boreholes in the formation;

placing a plurality of electrodes in the boreholes with at least one electrode per borehole, with the plurality of electrodes defining a fracture pattern for the geologic formation;

preconditioning by applying a sufficient amount of energy comprising AC power to the electrodes to induce an electrical field between opposite electrode contact points to generate a least one conductive channel between a pair of electrodes, wherein the conductivity in the channel between the pair of electrodes is defined as a ratio of final to initial channel conductivity of 10:1 to 50,000:1; and subsequent to generating the conductive channel, fracturing by applying electrical impulses to the electrodes, the electrical impulses having a voltage output ranging from 100-2000 kV, and an energy output of 10-1000 kJ, wherein the pulses have a rise time ranging from 0.05-500 microseconds and a half-value time of 50-5000 microseconds;

wherein the application of the electrical impulses generates multiple controlled fractures within and about the conductive channel by disintegration of minerals and pyrolysis of organic materials in the formation;

wherein the energy to generate the multiple controlled fractures is applied using a multiphase configuration.

11. The method of claim 10, wherein the multiphase configuration comprises three phases, six phases, nine phases, or twelve phases.

12. The method of claim 10, wherein the multiphase configuration comprises a plurality of three phases.

13. The method of claim 10, wherein the multiphase configuration comprises three phase Delta, three phase Wye, or any combination thereof.

14. The method of claim 10, wherein the multiphase configuration results in generating the multiple controlled fractures at a substantially same time.

15. The method of claim 10, wherein the multiphase configuration results in generating the multiple controlled fractures in a time sequence other than a substantially same time.

16. The method of claim 10, wherein the sufficient amount of energy applied to the electrodes to generate the conductive channel is selected from electromagnetic conduction, radiant energy and combinations thereof.

17. The method of claim 10, wherein the sufficient amount of energy applied to the electrodes is varied by time phasing of input current or voltage to change energy distribution between the electrodes in the boreholes and thereby controlling the fracturing pattern in the formation.

18. The method of claim 10, wherein the sufficient amount of energy ranges from 1 kV to 2 MV at a frequency range of 50 Hz to 100 MHz for any of continuous waveforms and pulsed waveforms.

19. The method of claim 10 after applying the sufficient amount of energy, further comprising:

measuring volumetric and channel electrical resistance between at least the pair of electrodes of the formation, wherein the measurement of volumetric electrical resistance is by the network analyzer and the measurement of channel electrical resistance is by impedance spectroscopy; and wherein the electrical impulses are applied after the impedance spectroscopy and network analyzer measurements to indicate sufficient reduction of electrical impedance or short circuit condition indicating presence of a conductive channel.

20. The method of claim 10, wherein at least one electrode is contained within a borehole wall, and wherein the at least one electrode is in contact with the borehole wall through a spring loaded pin or extends into the formation through the borehole wall telescopically.

21. The method of claim 10, wherein a resultant change in volume resistivity of the formation to be fractured is measured between a pair of boreholes by impedance spectroscopy method, with borehole to borehole network analyzer measurement made over a range of frequencies from 60 Hz to 10 MHz.

22. The method of claim 10, wherein the plurality of electrodes are connected to at least a surface waveform generator, and wherein the generator provides a voltage waveform to the electrodes for the multiple controlled fractures between the electrodes.

23. The method of claim 22, wherein the voltage waveform has a frequency spectrum that matches a measured spectrum impedance of channel electrical resistance created by the AC power.

24. The method of claim 22, wherein the voltage waveform exceeds 100 kilovolts in amplitude with a corresponding current exceeding 1000 amperes in magnitude at peak value of a generator output waveform.

25. The method of claim 10, wherein the plurality of electrodes are connected to at least a surface waveform generator for generating a time sequence of waveforms to generate electric shock wave excitations in the mineral and organic materials in the formation, thereby generating fracture volume in the formation.

26. The method of claim 10, wherein at least one of the electrodes further comprises a plurality of secondary electrodes.

27. The method of claim 26, wherein the plurality of secondary electrodes are placed in casing or open-hole in the boreholes to amplify radial electric field intensity initializing voltage discharge between the plurality of secondary electrodes and the formation.

28. The method of claim 10, further comprising injecting an ionizable gas in the boreholes.

29. The method of claim 10, further comprising using a borehole radar to gather information about the multiple controlled fractures generated in the formation, wherein the information about the multiple controlled fractures relates to any of distribution, size of fracture, and propagation velocity of the multiple controlled fractures generated in the formation;

wherein the information about the multiple controlled fractures includes any of location, orientation, and lateral extent of fracture zones intersecting the boreholes; or both.

30. The method of claim 10, wherein placing the plurality of electrodes in the boreholes comprises positioning the electrodes in the boreholes for forming electrode configurations selected from two-wire transmission line, four-wire transmission line, cage-like transmission line structure, antennas, and combinations thereof.

31. The method of claim 10, wherein the energy to generate the multiple controlled fractures is applied using the multiphase configuration and a single phase configuration.

32. The method of claim 10, wherein the multiphase configuration is not a three phase configuration.

33. The method of claim 10, wherein generation of the conductive channel is complete when current flow measured by a network analyzer exhibits a measured reduction of channel resistance of 90% ohms or more in 6 hours or less from when preconditioning first began.

34. A method of generating controlled fractures in a formation containing connate water, the method comprising:

applying a sufficient amount of energy comprising AC power to a plurality of electrodes placed in a plurality of boreholes in the formation, with at least one electrode per borehole, to induce an electrical field between opposite electrode contact points to generate at least one conductive channel between a pair of electrodes and to heat the connate water in the formation to either a subcritical condition or supercritical condition; and after generating the conductive channel, fracturing the formation by applying electrical impulses having a voltage output ranging from 100-2000 kV, and an energy output of 10-1000 kJ, wherein the pulses have a rise time ranging from 0.05-500 microseconds and a half-value time of 50-5000 microseconds;

wherein the application of the electrical pulses generates plasma shock waves in the water thereby creating multiple controlled fractures within and about the conductive channel in the formation;

wherein the energy to generate the multiple controlled fractures is applied using a multiphase configuration.

35. The method of claim 34, wherein the multiphase configuration comprises three phases, six phases, nine phases, or twelve phases.

36. The method of claim 34, wherein the multiphase configuration comprises a plurality of three phases.

37. The method of claim 34, wherein the multiphase configuration comprises three phase Delta, three phase Wye, or any combination thereof.

38. The method of claim 34, wherein the multiphase configuration results in generating the multiple controlled fractures at a substantially same time.

39. The method of claim 34, wherein the multiphase configuration results in generating the multiple controlled fractures in a time sequence other than a substantially same time.

40. The method of claim 34, wherein the formation is any of tight gas, shale gas, tight oil, tight carbonate, diatomite, geothermal, coalbed methane, methane hydrate containing formation, mineral containing formation, metal containing formation, or a bedrock formation having a permeability in the range of 0.01 microdarcy to 10 millidarcy.

41. The method of claim 40, wherein the formation contains gas, and wherein the multiple controlled fractures allows pressure in the formation to force recovery of gas contained within the formation.

42. The method of claim 40, further comprising one or a combination of:

(a) injecting any of steam and water into the formation and through the multiple controlled fractures, and recovering hydrocarbons from the formation;

(b) injecting a liquid stream into the formation and the multiple controlled fractures, and recovering hydrocarbons from the formation;

(c) pumping water out of the formation through the multiple controlled fractures, and recovering methane gas from the formation;

(d) recovering any of steam, heated water, and combinations thereof from the formation through the multiple controlled fractures; or (e) injecting any of water and steam into the formation into through the multiple controlled fractures for the water to be heated by the geothermal formation.

43. The method of claim 34, wherein the energy to generate the multiple controlled fractures is applied using the multiphase configuration and a single phase configuration.

44. The method of claim 34, wherein the multiphase configuration is not a three phase configuration.

45. The method of claim 34, wherein generation of the conductive channel is complete when current flow measured by a network analyzer exhibits a measured reduction of channel resistance of 90% ohms or more in 6 hours or less from when first applying the sufficient amount of energy comprising the AC power to the electrodes.

* * * * *